US008298027B1

(12) United States Patent
Basse

(10) Patent No.: US 8,298,027 B1
(45) Date of Patent: Oct. 30, 2012

(54) METHOD AND APPARATUS FOR USING A SKIM BOARD

(76) Inventor: Per H. Basse, Pittsburgh, PA (US)

( * ) Notice: Subject to any disclaimer, the term of this patent is extended or adjusted under 35 U.S.C. 154(b) by 91 days.

(21) Appl. No.: 12/802,708

(22) Filed: Jun. 11, 2010

Related U.S. Application Data

(60) Provisional application No. 61/186,324, filed on Jun. 11, 2009.

(51) Int. Cl.
*B63B 1/00* (2006.01)

(52) U.S. Cl. ..... 441/65; 441/75; 441/76

(58) Field of Classification Search ..... 114/39.12, 114/39.16; 441/65, 75, 76, 77, 66
See application file for complete search history.

(56) References Cited

U.S. PATENT DOCUMENTS

| | | | | |
|---|---|---|---|---|
| 3,758,898 | A * | 9/1973 | Dougherty | 441/77 |
| 4,129,313 | A | 12/1978 | Benson | |
| 4,462,327 | A * | 7/1984 | Pertramer et al. | 114/90 |
| 4,650,433 | A * | 3/1987 | Lee | 441/65 |
| 4,708,675 | A | 11/1987 | Shoeffler et al. | |
| 4,929,208 | A | 5/1990 | Corica | |
| 5,607,331 | A * | 3/1997 | Lekhtman | 440/23 |
| 6,428,376 | B1 | 8/2002 | Reeder | |
| 6,592,150 | B2 | 7/2003 | Kernan | |
| 6,634,657 | B2 | 10/2003 | Graham | |
| 6,923,455 | B2 | 8/2005 | Sullivan | |
| 7,029,351 | B1 | 4/2006 | Reid et al. | |
| 2004/0070175 | A1 | 4/2004 | Jacobi | |
| 2010/0099313 | A1 * | 4/2010 | Morgan | 441/65 |

FOREIGN PATENT DOCUMENTS

| | | |
|---|---|---|
| FR | 2732609 | 10/1996 |
| FR | 2732610 | 10/1996 |
| JP | 63-88362 | 6/1988 |
| JP | 2001-31008 | 11/2001 |

* cited by examiner

*Primary Examiner* — Stephen Avila
(74) *Attorney, Agent, or Firm* — Price & Adams

(57) ABSTRACT

A pair of poles are positioned for pivotal connection adjacent the lateral edges of a skim board. A rider initially stands on the beach behind the board and grips the poles. The rider runs on the beach behind the board to forwardly propel the board on the low friction surface of the shallow water. The speed and direction of the board is controlled by the rider manipulating and pivoting the poles. When the board reaches a desired speed, the rider jumps with one foot onto the board while gripping the poles to control balance and direction of movement of the board. The rider places his other foot on the board as the board glides on the surface of the water. By continuing to grip and pivot the poles, the rider stabilizes his position on the board until the board completes the gliding movement and comes to a stop.

19 Claims, 19 Drawing Sheets

METHOD AND APPARATUS FOR USING A SKIM BOARD

CROSS-REFERENCE TO RELATED APPLICATION

This application claims the benefit of U.S. Provisional Application No. 61/186,324, filed on Jun. 11, 2009. The disclosure of the above provisional application is incorporated herein by reference.

BACKGROUND OF THE INVENTION

1. Field of the Invention

This invention relates to a board for supporting a rider to glide on a low friction surface and, more particularly, to a method and apparatus for stabilizing the position of a rider on a skim board for gliding on shallow surf.

2. Description of the Prior Art

The use of riding boards to traverse by gliding on low friction surfaces is a popular recreational activity. Sleds, downhill skis, and snowboards are commonly used equipment to traverse ice and snow covered surfaces. Bodyboards and surfboards are used to ride the front face of a breaking wave at a sea coast. Surfboards are longer than bodyboards so as to allow the surfer to stand on the upper surface of the surfboard and move along the length of the board during the course of riding a wave. Bodyboards are smaller than surfboards because the rider is in a prone position on the board. Only the upper part of the rider's body is supported by the board with the legs extending from the board into the water. The rider of a bodyboard does not stand on the bodyboard in comparison with a surfboard. However, with both a surfboard and a bodyboard the rider relies upon shifting body weight to control the direction of travel of the board through the surf.

Surfboards and bodyboards are used in heavy surf and in deeper water. Conventionally, bodyboards are self-propelled for riding the surf along the beach. It is also known to ride a wakeboard as it is pulled behind a motor boat, as a modification to water skiing. A wakeboard resembles a surfboard, in that the rider stands on a elongated board which is shorter in length than a surfboard. Like a snowboard, a wakeboard is provided with fixed bindings for each foot where the rider stands sideways, as on a skateboard.

A further modification of a wakeboard is a wakeskate, which has a shape and configuration similar to a wakeboard, but the rider's feet are not confined to bindings. The rider of a wakeskate is also pulled behind a motor boat. A wakeskate can be used freestyle on shallow water, such as in ocean surf or on inland shallow water surfaces.

In comparison with wakeboards and wakeskates, skim boards are used to glide on the receding wave along an ocean shoreline or any other body of shallow water. In comparison to a snowboard and a skateboard, skim boards have a flat football-like shape. Commonly, skim boards are fabricated of fiber glass or wood or combinations thereof and generally range in length between about 42 inches to 44 inches. For children and younger riders, a skim board is shorter in length than for an adult rider. Skim boards are self-propelled. Instead of riding a wave as it breaks onto a shoreline, a skim boarder rides the end of a breaking wave as it recedes from the shoreline. The skim board glides over several inches of water as the wave dissipates on the sand surface. It is also known to use skim boards to ride breaking waves in deeper water in the manner of using a bodyboard.

With all of the above-described board sports, the rider is seeking to enhance the riding experience by maximum comfort and control of movement of the board on the low friction surface, such as snow, ice, water, or surf. Accordingly, to enhance the rider's comfort and control on a riding board, a number of training aids and accessories have been proposed. In the sport of snowboarding, it is known to attach handles to the snowboard to aid the rider in achieving improved balance and control of the snowboard.

U.S. Patent Application No. 2004/0070175 discloses a snowboard having front and rear flexible cords attached to the snowboard. The rider grasps the front cord with one hand and the rear cord with the other hand. By grasping the cords, the rider is able to obtain stability and balance on the board.

U.S. Pat. No. 6,923,455 discloses a snowboard converted into a snow scooter by the provision of a two handle assembly attached to the front and rear portions of the snowboard. The rider stands on the middle of the snowboard and grasps the two handles to control the movement of the board without the use of foot bindings.

For beginners, mastering a board sport is very difficult because of the athletic skill required to maintain stability and balance on the board while controlling the direction of movement of the board. U.S. Pat. No. 6,634,657 discloses a training device for teaching a rider how to balance and control a snowboard by the provision of a handle device that is retrofitted to an existing snowboard to eliminate the need for foot bindings so that the rider's position is not locked onto the snowboard. Front and rearwardly positioned handles extend upwardly from the snowboard, and the rider stands between and grasps the handles.

U.S. Pat. No. 7,246,804 discloses a further embodiment of a snowboard using a handle as a training aid. A handle is pivotally connected to the front end of the snowboard and extends upwardly and rearwardly in an arcuate path to a position convenient for the rider to grasp while standing on the board. A similar training device is disclosed in U.S. Pat. No. 4,129,313 having a pivotal handle extending from the front of a monoski rearwardly to where the rider stands or sits on the ski. The handle is pivotal to a position where it is grasped by the rider standing on the board or to a lower position where the rider is seated on the board.

U.S. Pat. No. 6,592,150 discloses a training device to teach beginning downhill skiers how to control speed and direction of travel. The skier uses a pair of conventional downhill skis with a monoski having a handle positioned forwardly and centered on the downhill skis. The skier grasps the handle of the third ski and does not use conventional ski poles to maintain balance and control direction.

French Patent Nos. 2732609 and 2732610 and Japanese Patent Document 2001-310008 disclose training devices for teaching beginners how to use a snowboard. The snowboard includes a handle that is secured to and extends upwardly from a selected position on the board. Grasping the handle provides the rider with greater stability on the board in gliding on the snow surface.

Devices for maintaining control and balance on an aquatic board have also been proposed as, for example, in U.S. Pat. No. 6,428,376. A bodyboard is provided with a handle positioned centrally close to the surface of the board at the forward edge thereof. The handle provides the rider with more control when riding the board and, as a result, helps to keep the rider on the board during use.

In U.S. Pat. No. 7,029,351, a bodyboard is provided with a handle assembly that includes a handle bar formed of left and right bars extending outwardly from a base that is positioned centrally on the forward end portion of the bodyboard. U.S. Pat. No. 4,708,675 is example of a bodyboard provided with a pair of rudders positioned laterally at the forward end portion of the bodyboard. The rudders are connected to a single handle by a pulley and belt mechanism to allow the rider to steer the bodyboard via turning the rudders in unison through the single handle.

In the use of a wakeboard, Japanese Patent Document 63-88362 discloses two embodiments for controlling the movement of a wakeboard by the rider standing in one embodiment on the wakeboard and in a second embodiment extending the body prone from the rear of the wakeboard. In the case of surfboards, U.S. Pat. No. 4,929,208 proposes a flexible handle that is raised from a stored position on a surfboard to an extended position for grasping by the surfer standing on the board. The surfer grasps the handle to press his feet against the surfboard to allow the surfer to perform aerial maneuvers not otherwise attainable with a conventional surfboard.

Skim boarding presents the rider with a challenge of maintaining balance while controlling the movement of the board as it glides on the shallow wake of a wave washing over the surface of a beach. Unlike surfboards, bodyboards, and wakeboards, skim boards are used in very shallow water at the surf's edge on the beach. Also, unlike the other types of boards described above, a skim board is propelled by the rider performing what is known as the "run-drop-slide" technique. Preferably, the technique is performed on a flat beach which provides the rider with a long gentle run in comparison with a rider on a beach having a steeper slop to provide a faster ride in a shorter time interval.

The rider standing at the shoreline grasps the skim board in both hands, one midway along each edge and holds the board to one side of the body. Waiting for the ideal wave and judging the timing of the wave is critical in initiating the "run-drop-slide" technique. The rider can glide atop a wave as it crashes onto the beach or wait for the wave to recede back into the ocean.

With the skim board in hand, the rider runs to approach a wave at a 45° angle. As the wave begins to recede on the beach to a depth of about 3 inches, the rider throws the board flat onto the shallow water. The board skims on the surface of the water as the rider runs along side of the board. At the optimum time, the rider jumps onto the board with one foot positioned at the back of the board followed by the second foot positioned forwardly on the board. Both feet are angled on the board so that the toes point to one side of the board. The rider's weight is centered and balanced on the board. With this maneuver successfully completed, the rider will skim along the inches of water receding from the beach.

A successful skim board ride will be determined to a great extent by the rider maintaining his weight centered on the board so that the board does not slide out from underneath the rider, causing the rider to be hurled off the board onto the sandy shore. Because maintaining balance is such a difficult maneuver, a rider will experience many wipeouts before he masters the technique of skimming across the surface of the water. If the rider's balance is not centered, then the tip of the skim board will dig into the sand or the skim board will slip out from underneath the rider.

One of the most difficult aspects of skim boarding for the rider to master is to synchronize the speed of running on the beach with the speed of the board after it is dropped onto the surf. If the rider does not jump onto the board at the right speed, then he will lose his balance and fall off the board. When the rider falls off the board, he losses control of it which can continue to skim at high speed. This presents a dangerous condition to bystanders on the beach in being struck by the runaway skim board.

Because skim boarding requires good body control and coordination, it is a difficult technique to master. For this reason, learning to ride a skim board is frustrating to most users, and particularly, beginners and the younger riders. Therefore, there is need for an apparatus that makes it easier for a rider of a skim board to learn the techniques of timing and balance that are essential for successful skim board operation.

SUMMARY OF THE INVENTION

In accordance with the present invention, there is provided apparatus for sliding on a low friction surface that includes a board having a top surface for supporting a rider standing on the board. A bottom surface of the board slides on the low friction surface. The board is provided with a front end and a rearward end. Spaced apart side edges extend the length of the board between the frontend and the rearward end. A pair of poles is mounted in spaced relation on the top surface adjacent to the board side edges. The poles each have at an upper end portion a handle for gripping by the rider and at a lower end portion a connecting device for attaching the poles to the board top surface to permit the rider to independently pivot the poles in a selected direction relative to the board top surface.

Further, in accordance with the present invention, there is provided a skim board for gliding along the shallow waves on a beach. A top surface of the board supports a standing rider. A bottom surface contacts the shallow waves flowing over the beach. The top surface is defined by front and back ends and lateral edge portions. A pair of poles extends upwardly from the top surface adjacent to the lateral edge portions. The poles each have a handle portion for gripping by the rider and a base portion connected to the top surface for pivotal movement controlled by the rider in getting on and off the board as the board glides on the waves.

In addition, the present invention is directed to a method for controlling the movement of a skim board gliding on a low friction surface that includes the step of pivotally connecting a pair of poles to lateral sides of the skim board for movement of the poles by a rider ranging between a vertical position and a horizontal position relative to the surface of the skim board. Movement of the skim board on the low friction surface is accelerated by the rider running behind the skim board while grasping ends of the poles to forwardly propel the skim board on the low friction surface. The poles are pivoted to a preselected position on the skim board by the rider as the skim board glides on the low friction surface. When the desired speed of the skim board is reached on the low friction surface the rider steps onto the surface of the skim board while continuing to maintain control of the skim board on the low friction surface by the rider pivoting the poles. The rider maintains balance on the skim board by selectively pivoting the poles as the skim board glides on the low friction surface. When forward movement of the skim board is terminated on the low friction surface the rider steps off of the surface of the skim board while continuing to grip the poles and maintain control of the skim board when off of the skim board.

Accordingly, a principal object of the present invention is to provide a rider on a board for gliding on a low friction surface with apparatus that enhances the rider's ability to maintain balance and control of the board during movement.

Another object of the present invention is to provide a rider on a board used to traverse the surface of water, snow or ice with a device that enables the rider to maintain control of the board for a successful ride.

A further object of the present invention is to provide a skim board with a device for controlling the movement of the skim board to enable the rider to maintain proper balance and control to successfully maneuver the skim board for a longer and safer ride on the surface of a wave.

Another object of the present invention is to provide a device that can be retrofitted to a skim board to facilitate the development of the techniques required to successfully maneuver a skim board.

These and other objects of the present invention will be more completely disclosed and described in the following specification, accompanying drawings, and appended claims.

BRIEF DESCRIPTION OF THE DRAWINGS

FIG. 24 is a further view of the pole similar to

FIGS. 22 and 23, illustrating a ring-shaped handle for the pole.

DESCRIPTION OF THE PREFERRED EMBODIMENTS

Figure 1:
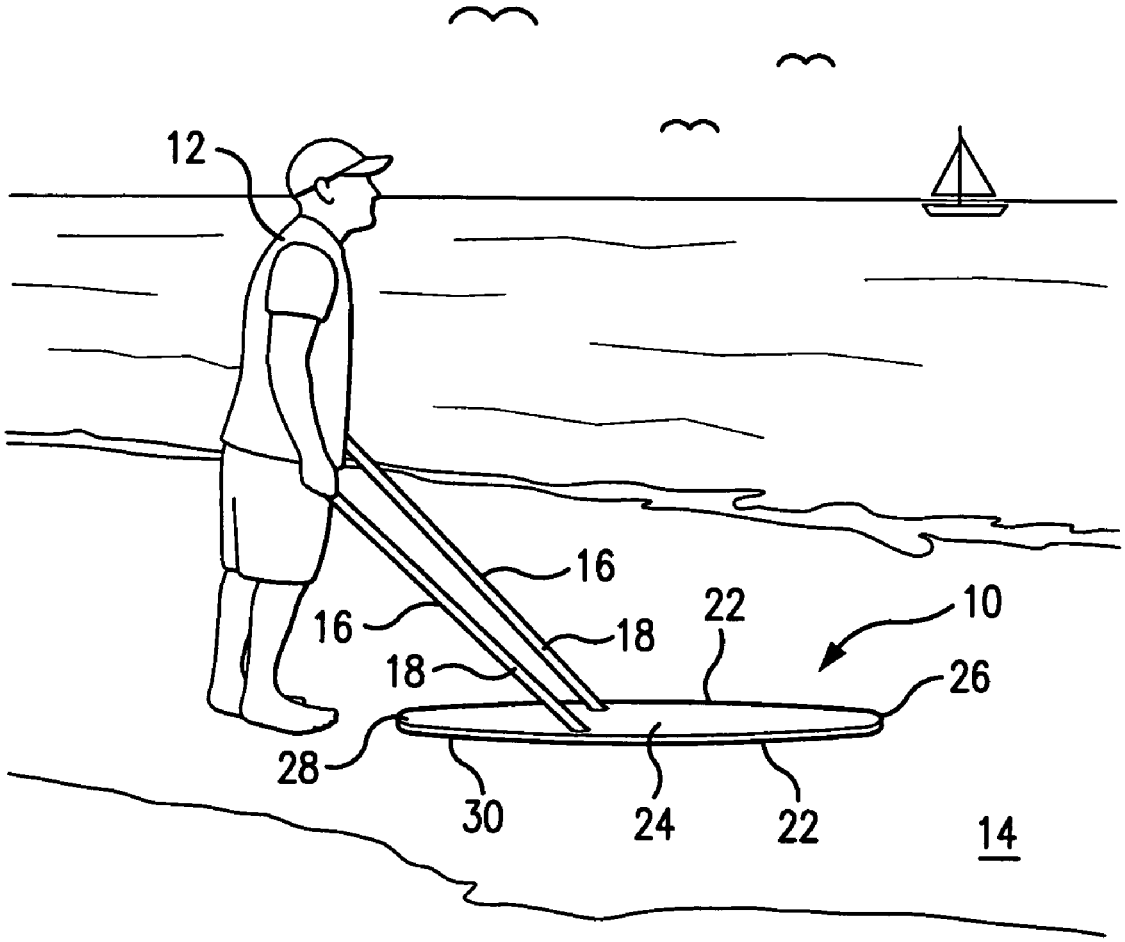
FIG. 1 is an isometric schematic view of a skim board for riding the shallow waves on a beach, illustrating apparatus attached to the board for providing the rider with enhanced control of the board.

Referring to the drawings, and particularly, to FIGS. 1 and 2, there is illustrated a skim board generally designated by the numeral 10 that is maneuvered by a rider 12 for gliding or skimming on the surface of a wave as it washes up onto a beach, most commonly at the shoreline of an ocean. In accordance with the present invention, control and maneuvering of the skim board 10 by the rider 12 is facilitated by a pair of poles 16 hingedly connected at lower end portions 18 by attachment devices 20 adjacent to lateral edge portions 22 on an upper surface 24 of the skim board 10. The skim board 10 is defined in configuration by the lateral edge portions 22 terminating in a front end 26 and a rearward end 28. A bottom surface 30 of the skim board glides on the water surface on the beach or on any low friction surface, including ice and snow.

The method of using the skim board in accordance with the present invention for gliding on the shallow waves washing up on a beach is illustrated in FIGS. 2*a*-2*f*. To initiate a ride on the skim board, the rider, as illustrated in FIG. 1*a* grips the pole 16 from a position standing on the beach behind the skim board. In this position, the poles 16 are pivoted at an angle where the rider can grasp the poles and push on the poles to forwardly accelerate the skim board on the sand as the rider runs behind the board.

The rider continues to run on the beach pushing the poles 16 to accelerate the board to a desired speed. In this manner, the rider maintains contact with the board to control the direction of movement of the board at a preselected speed. Preferably, at the point where the surf begins to recede after the wave is broken onto the beach, the rider executes the one-step movement of planting one foot on the board, as shown in FIG. 2*b*. During this maneuver, the rider is able to maintain his balance as he steps on the board because the rider is advancing at the same speed as the board traversing the surf. Balance on the board is achieved by selectively pivoting the poles relative to the board.

The poles are independently pivotal so that the rider is able to move the poles through a wide range of angular motion that allows the rider to maintain his balance as he steps onto the board. After one foot is planted on the board, the rider plants his other foot on the board, as shown in FIG. 2*c*, to ride the board as it glides or skims along the shallow depth of water as it recedes back toward the ocean.

Figure 2A:
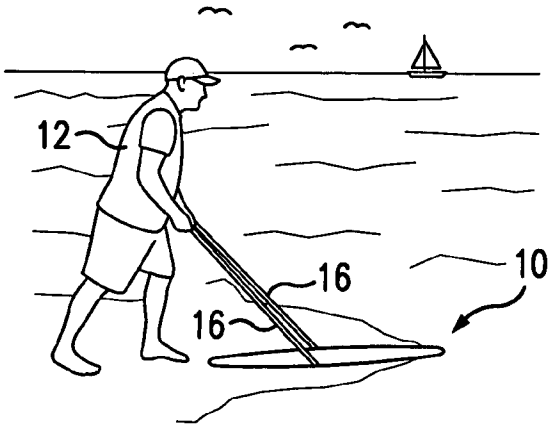
FIGS. 2*a*-2*f* are isometric schematic views of the sequences of steps in maneuvering the skim board with apparatus for controlling the skim board to ride the surf on a beach.
Figure 2B:
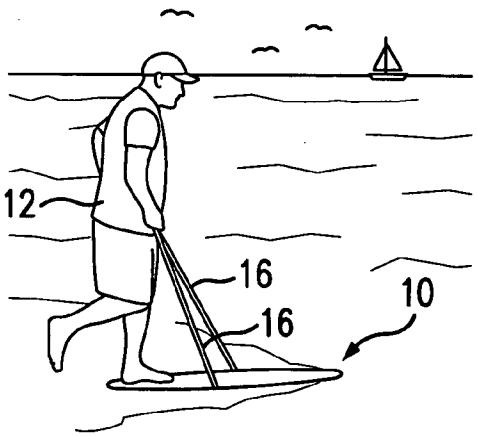
Figure 2C:
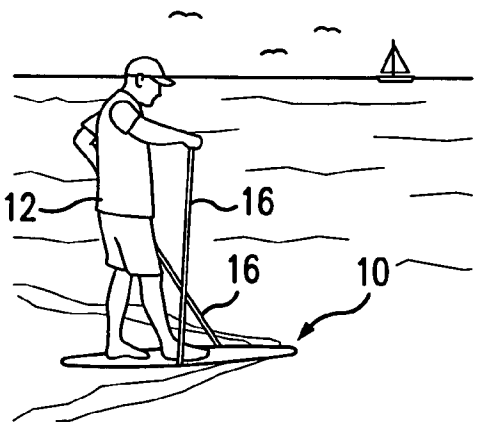
Figure 2D:
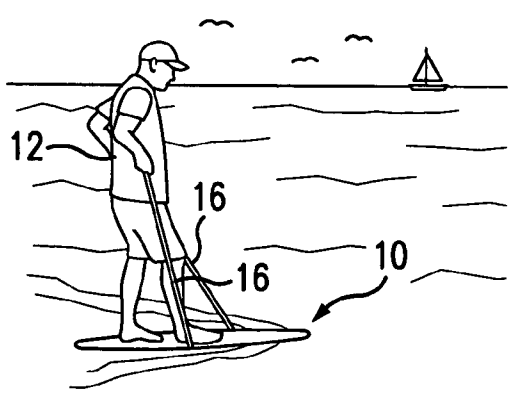
Figure 2E:
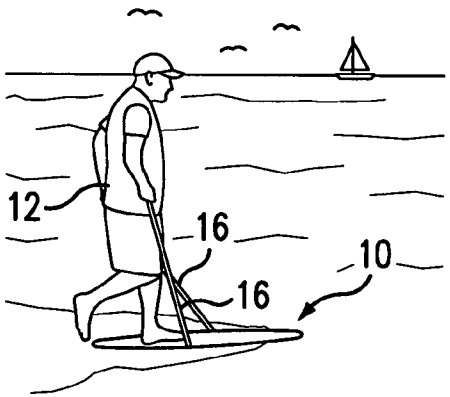

As the gliding continues, as shown in FIG. 2*d*, the rider adjusts his position and balance on the board by moving the poles to a desired angular position. The gliding maneuver continues until the water has receded back to the ocean and the skim board comes to rest on the bare sand, as shown in FIG. 2*e*. During this process, the rider continues to grasp the poles to maintain control and balance on the board so that the board does not slide out from underneath the rider's feet.

Figure 2F:
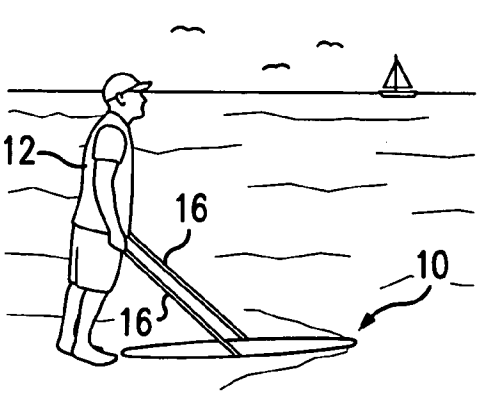

During the entire process, the rider remains in contact with the board by gripping the poles 16 while he is off the board, as well as, when he is on the board. When the ride comes to an end, the rider steps off the board and remains in contact with the board to initiate the next ride, as shown in FIG. 2*f*.

By the provision of the poles 16 allowing the rider to remain in contact with the board at all times, the rider obtains better balance when stepping on and off the board. This ensures a safer and more enjoyable ride, which is longer in comparison with the conventional skim boarding technique where the rider tosses the board on the surf and steps on the board, which is moving independently of the rider.

Figure 3:
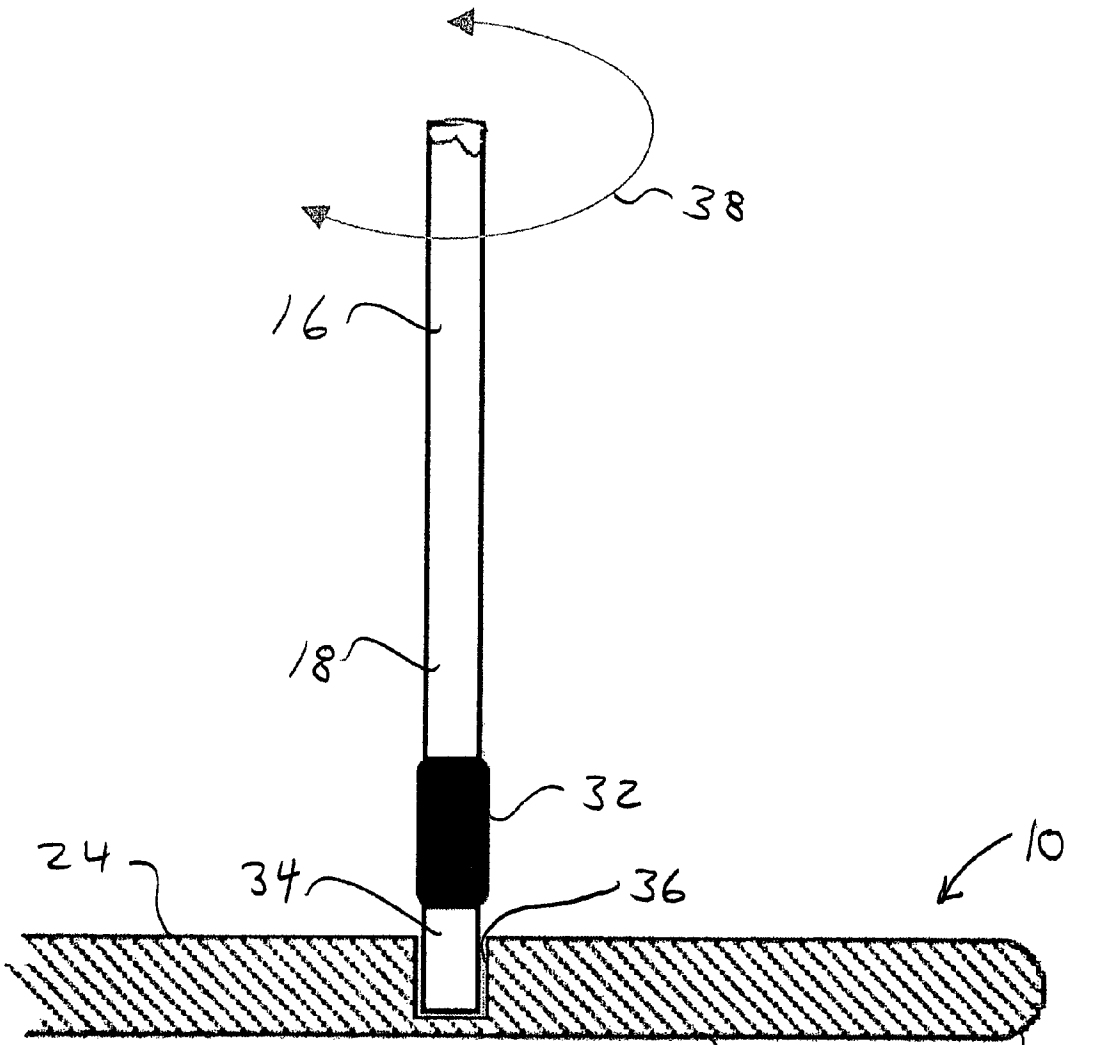
FIG. 3 is a fragmentary sectional view in side elevation of a portion of the skim board shown in FIG. 1, illustrating a flexible pole attached to the skim board for controlling movement of the board in use.

A principal feature of the present invention, shown in FIG. 3, is the provisions of a flexible joint 32 connecting the base of the pole 16 to the upper surface 24 of the board 10. The flexible joint 32 connects the base of the pole 16 to a stub shaft 34 that extends from a recess 36 in the board surface 24. In one embodiment, the stub shaft 34 is permanently secured to the board 10 within the recess 36, such as by gluing or any other type of connection for permanently securing the stub shaft 34 to the board 10.

The flexible joint 32 may take any desired construction that facilitates pivotal movement of the pole 16 relative to the stub shaft 34 and the board surface 24. In one embodiment, the flexible joint 32 includes a rubber sleeve that receives the pole lower end portion and is press fit at an opposite end onto the stub shaft 34. Preferably, the sleeve 32 with the pole 16 is rotatable through an angle of 360° on the stub shaft 34, as indicated by the directional arrow 38 in FIG. 3.

Figure 4:
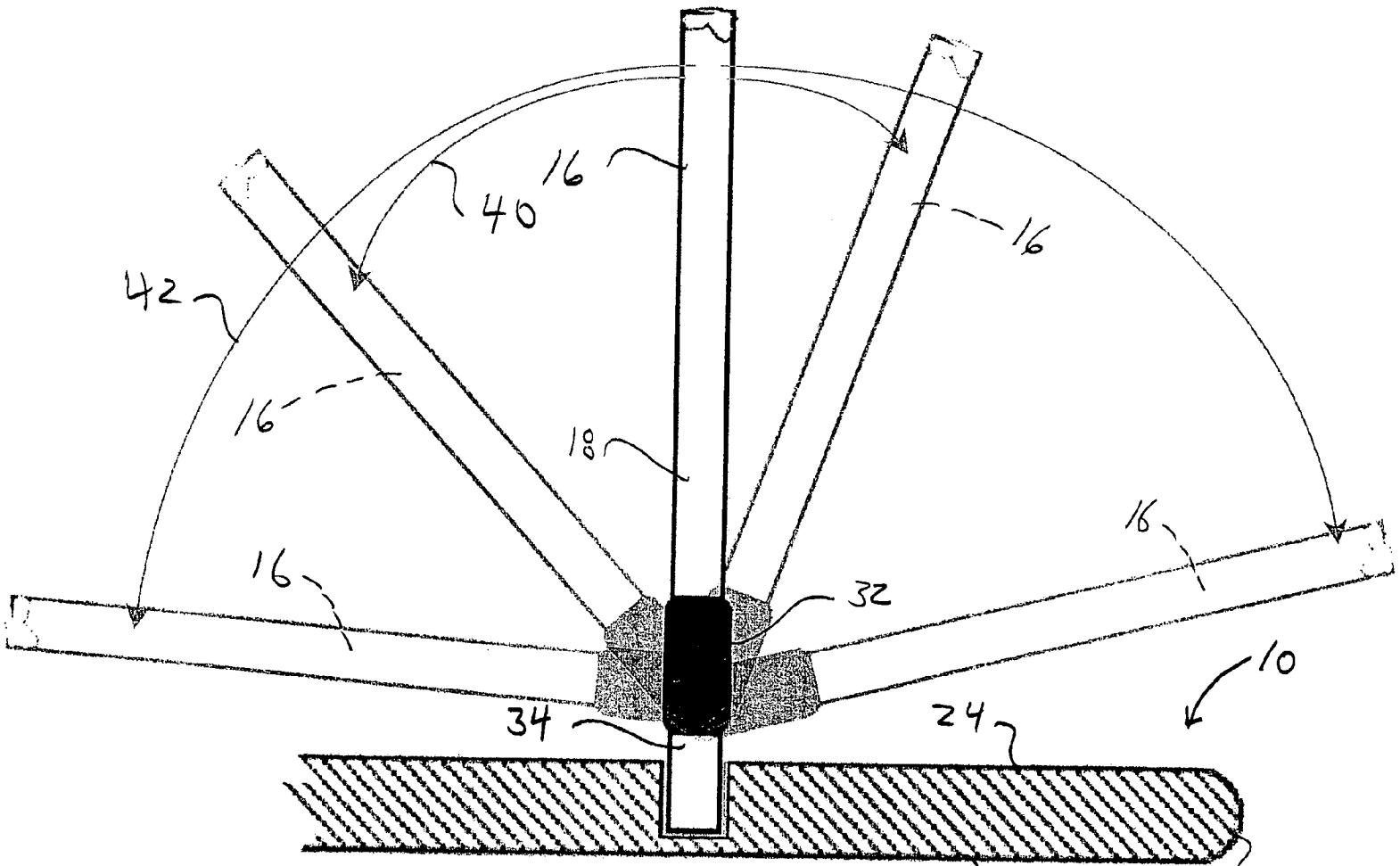
FIG. 4 is a view of the skim board similar to FIG. 3, illustrating the range of pivotal movement provided by the flexible connection of the pole to the skim board.

In other embodiments, the flexible joint 32 includes rubber tubing, a coil spring, a swivel, a universal joint, and the like for receiving the base of the pole 16. The stub shaft 34 permits the pole 16 to rotate about its longitudal axis through 360°. As illustrated in FIG. 4, the pole 16 is pivotal by the provision of the flexible joint 32 through an angle of substantially 180° along the longitudal axis of the board 10, as indicated by the directional arrows 40 and 42 in FIG. 4.

In one example, the flexible joint 32 permits the pole to pivot through an angle illustrated by the directional arrow 40 from a forwardly pivoted position above the board front end 26 to a rearward position on the board. A greater range of pivotal movement of the pole 16 about the longitudal axis of the board is illustrated by the directional arrow 42. In this example, the pole is pivoted through a range of movement close to the board surface 24.

It is the pivotal movement of the poles 16 on the lateral edges 22 of the board 10 that enables the rider to position the handles at a relatively low angle above the board when beginning to accelerate the board from a stationary position, as illustrated in FIG. 2*a*. As the board 10 is accelerated by the rider pushing on the poles 16, the angle of the poles relative to the surface 24 of the board 10 is raised toward a vertical position, as shown in FIG. 2*b* when the rider steps onto the board with one foot.

When both feet are on the board 10, as shown in FIG. 2*c*, the rider adjusts the angular position of the poles 16 to maintain his balance on the board 10 and control the direction of movement of the board 10 as it glides on the surface of the water. In addition, the poles 16 are also pivotal through an angle of substantially 180° along the transverse axis of the board to allow the ends of the poles to be moved toward or away from one another.

In FIGS. 2*a*-2*f*, the rider is shown maneuvering the skim board while maintaining his grip at all times on the poles 16. The rider may, at his discretion, once he has mounted the board 10, as shown in FIGS. 2*c* and 2*d* and has established control and balance, release his grip from the poles 16. The poles 16 then fall along the lateral edge portions 22 of the board 10 and slide with the board 10 as it glides on the surface of the water. With this maneuver, the rider can obtain a conventional pole-free ride on the skim board 10. The released poles do not interrupt the gliding motion of the board.

In the event that the rider should loses his balance on the board 10 while grasping the poles 16, the flexible connection of the poles 16 to the board 10 at the joint 32 ensures that the poles 16 fall downwardly when released by the rider. The poles 16 will not interfere with the rider's maneuver of stepping off the board 10. In this manner, the rider releases himself from contact with the board 10 and avoids losing his balance and falling off the board.

Figure 5:
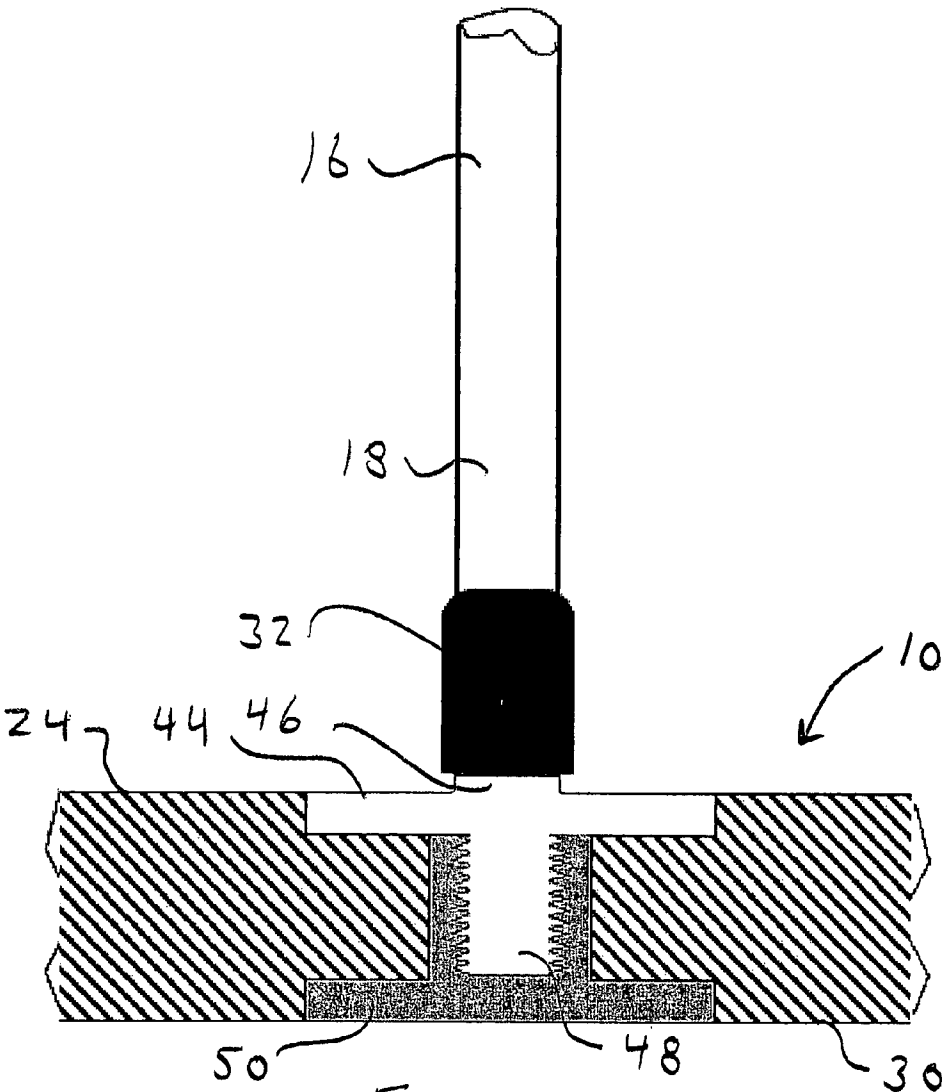
FIG. 5 is a fragmentary sectional view in side elevation of the skim board, illustrating the pole connected by a flexible joint for fixed engagement to the skim board.

In an arrangement similar to the connection of the pole 16 to the skim board 10 as shown in FIG. 3, a permanent connection of the poles 16 to the board 10 is shown in FIG. 5. The lower end portion or base 18 of the pole 16 is connected through the flexible joint 32 to a base plate 44 that is permanently mounted on the upper surface 24 of board 10. A stub shaft 46 of the base plate 44 extends upwardly into engagement with the lower end of the flexible joint 32. An externally threaded shaft 48 extends downwardly from the base plate 44 into threaded engagement with an internally threaded receiver 50 mounted in the body of the skim board 10. With this arrangement, the pole 16 is connected to the skim board 10 and is pivotable about the flexible joint 32 in longitudal and traverse directions. The pole 16 can be disconnected from the skim board by rotating the base plate 44 to threadedly advance the shaft 48 from the receiver 50.

Figures 6, 7:
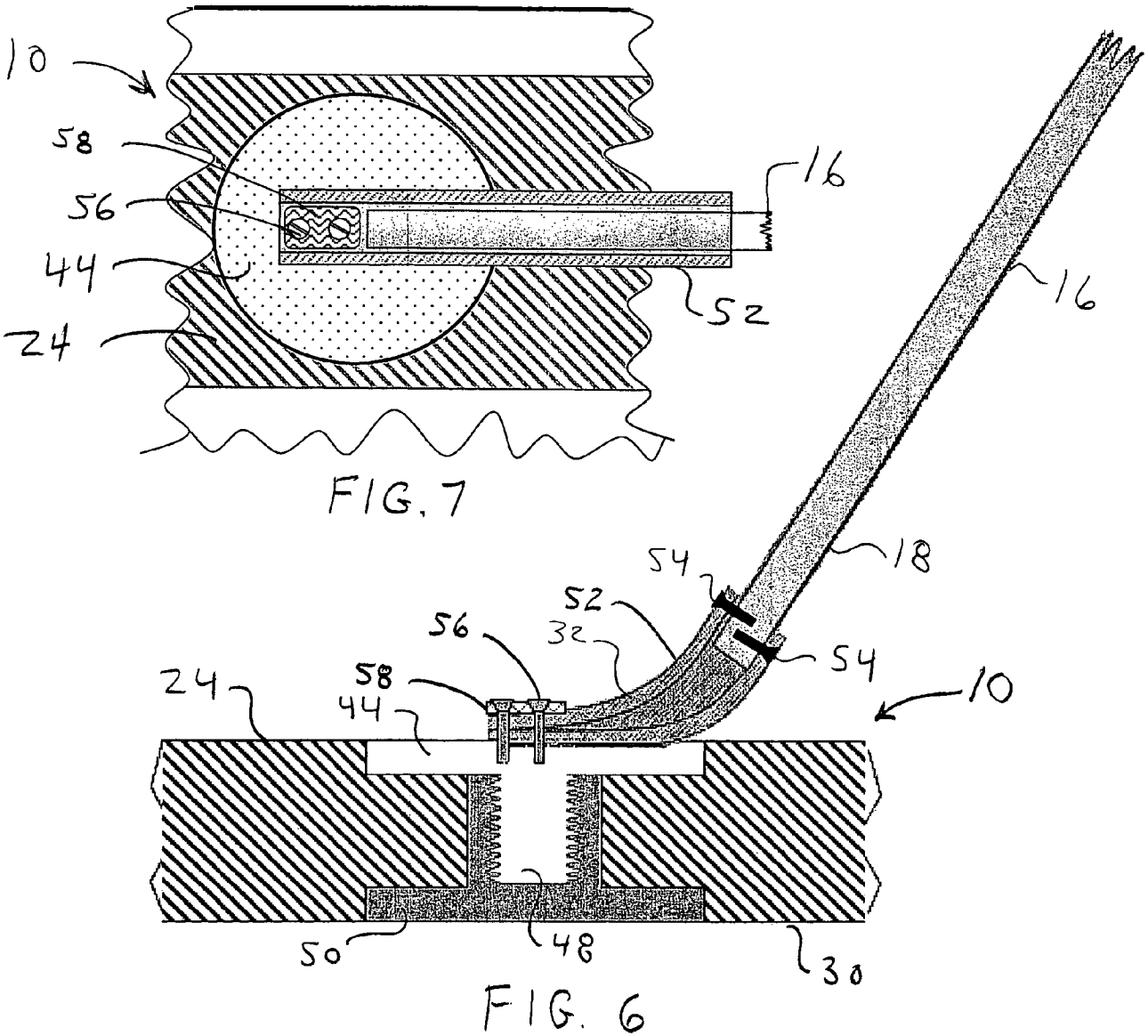
FIG. 6 is a view of the skim board similar to FIG. 5, illustrating another embodiment of flexibly connecting the pole to the skim board.
FIG. 7 is a fragmentary, sectional top plan view of the skim board shown in FIG. 6.

Referring to FIGS. 6 and 7, there is illustrated another embodiment for permanently securing the pole 16 to the surface 24 of the skim board 10 by connecting the end of the pole to the base plate 44 of the receiver 50 in the body of the board 10. With the arrangement shown in FIG. 6, the flexible joint 32 for connecting the pole 16 to the board 10 includes a section of rubber tubing 52. The tubing 52 is connected at its upper end by fasteners 54 to the end of the pole 18. The tubing is connected at a lower end by a pair of fasteners 56 extending through a bearing plate 58 and the lower end of the rubber tubing 52 into engagement with the base plate 44.

The rubber tubing 52 is connected to the pole 16 at one end and at the opposite end to the base plate 44 mounted on the board 10. This connection of the pole 16 to the board 10 also provides for lateral and transverse pivotal movement of the pole 16 relative to the surface 24 of board 10. Also, the pole 16 is rotatable about the connection of the tube 52 to the base plate 44.

Figure 8:
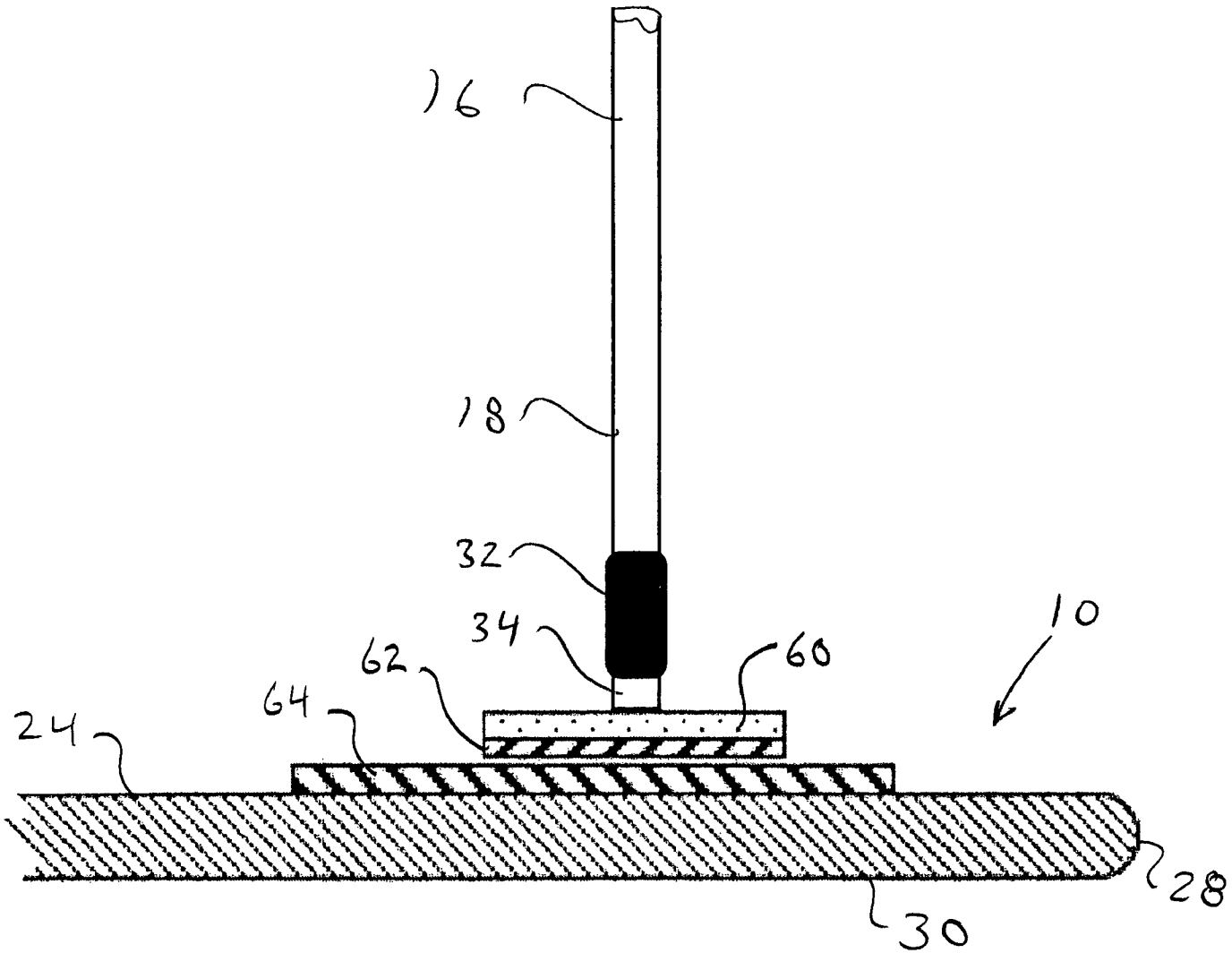
FIG. 8 is a fragmentary, sectional view in side elevation of the skim board, illustrating a flexible pole removably connected to the skim board.
Figure 9:
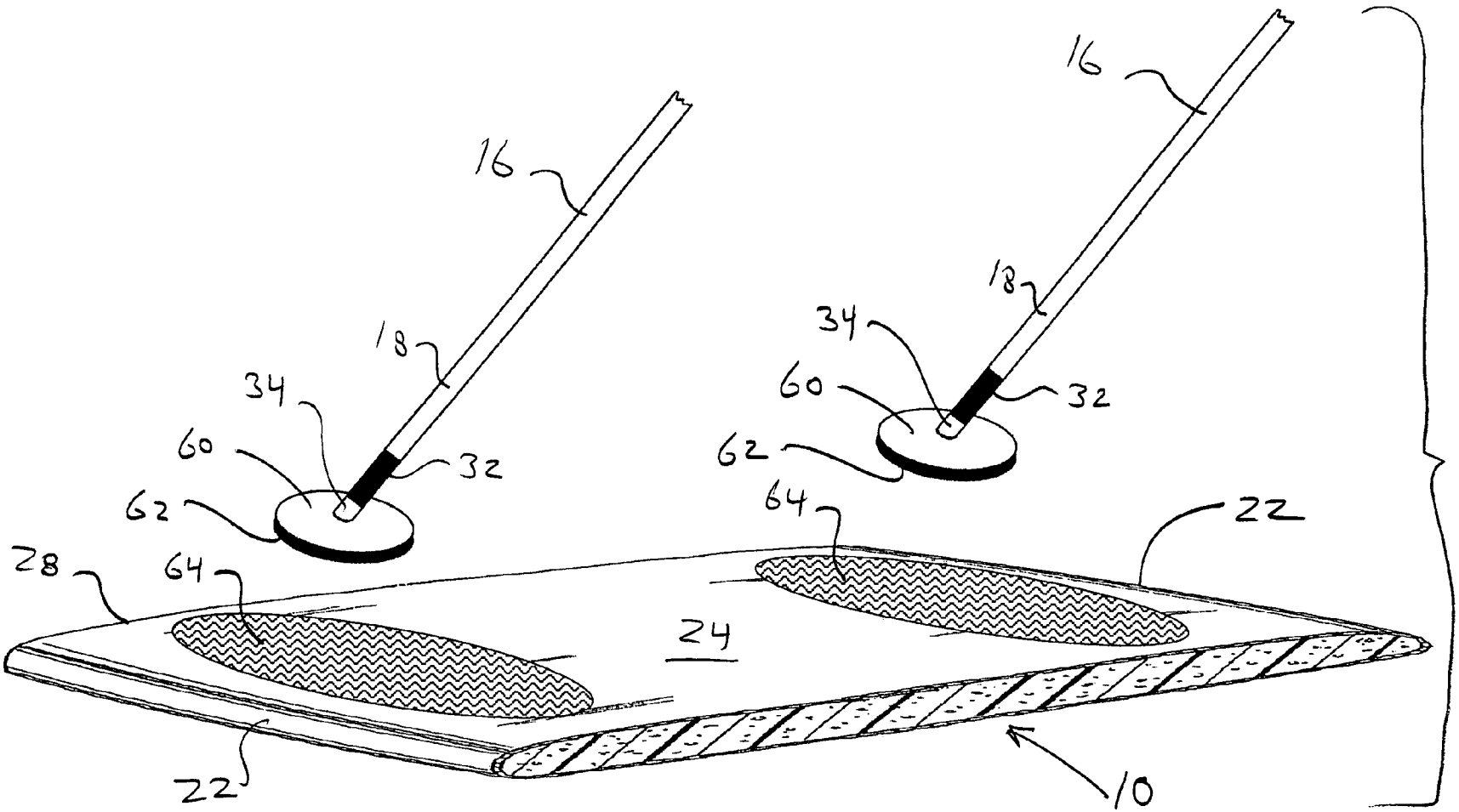
FIG. 9 is a fragmentary, exploded sectional view of the skim board, illustrating the flexible poles removed from connection to the skim board.

FIGS. 8 and 9, illustrate another embodiment of removably connecting the poles 16 to the surface 24 of the skim board 10. The poles 16 are pivotal through angles of 180° about the lateral and transverses axes of the skim board 12 and rotatable through 360° about the longitudal axis of the pole 16. The pole 16 is connected by the flexible joint 32 to a stub shaft 34 mounted on a circular plate 60. A hook and loop fastener portion 62, such as sold under the trademark "Velcro", is attached to the bottom of circular plate 60 for coupling with a second cooperating hook and loop fastener portion 64 permanently attached to upper surface 24 of the board 10.

As shown in FIG. 9, the hook and loop fasteners 64 are secured to extend longitudally adjacent to board lateral edge portions 22 at the rearward end 28 of the board 10. The length of the fastener portions 64 exceed by several times the diameter or length of the hook and loop fastener portions 62 secured to the bottom of plates 60 on which the poles 16 are mounted. This arrangement allows the rider to selectively position each pole 16 at the board lateral edge portions 22.

Figure 10:
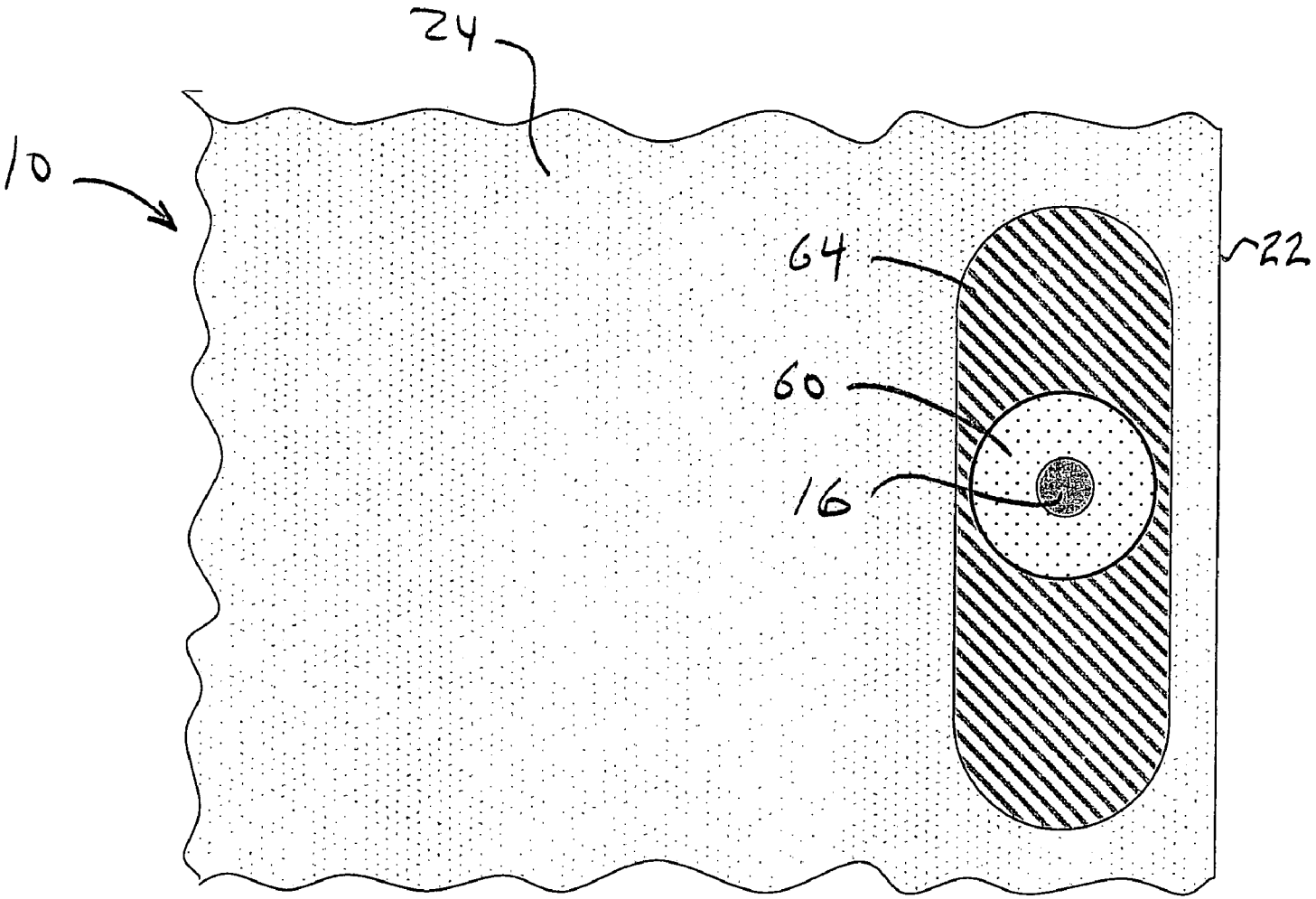
FIG. 10 is a fragmentary, sectional top plan view of the skim board, illustrating a hook and loop fastener extending along a length of the lateral edge of the board to permit selective positioning of the pole on the board.

As shown in FIG. 10, the length of the hook and loop fastener portion 64 at the board lateral edge portion 22 allows for selective positioning of the pole 16. The range of positioning is determined by the length of the fastener portion 64, which exceeds substantially the diameter of the circular plate 60.

In one arrangement, the poles 16 are positioned diametrically opposite of one another on the board 10. In another arrangement, the poles 16 are longitudinally displaced from one another where one pole 16 is closer to the board rearward end 28 than the other pole 16. With the embodiment of releasably mounting the poles 16 on the board 10, the poles 16 can be removed from the board to allow conventional use of the skim board without poles. This feature permits conversion of a skim board from conventional use to use in accordance with the present invention.

Figure 11:
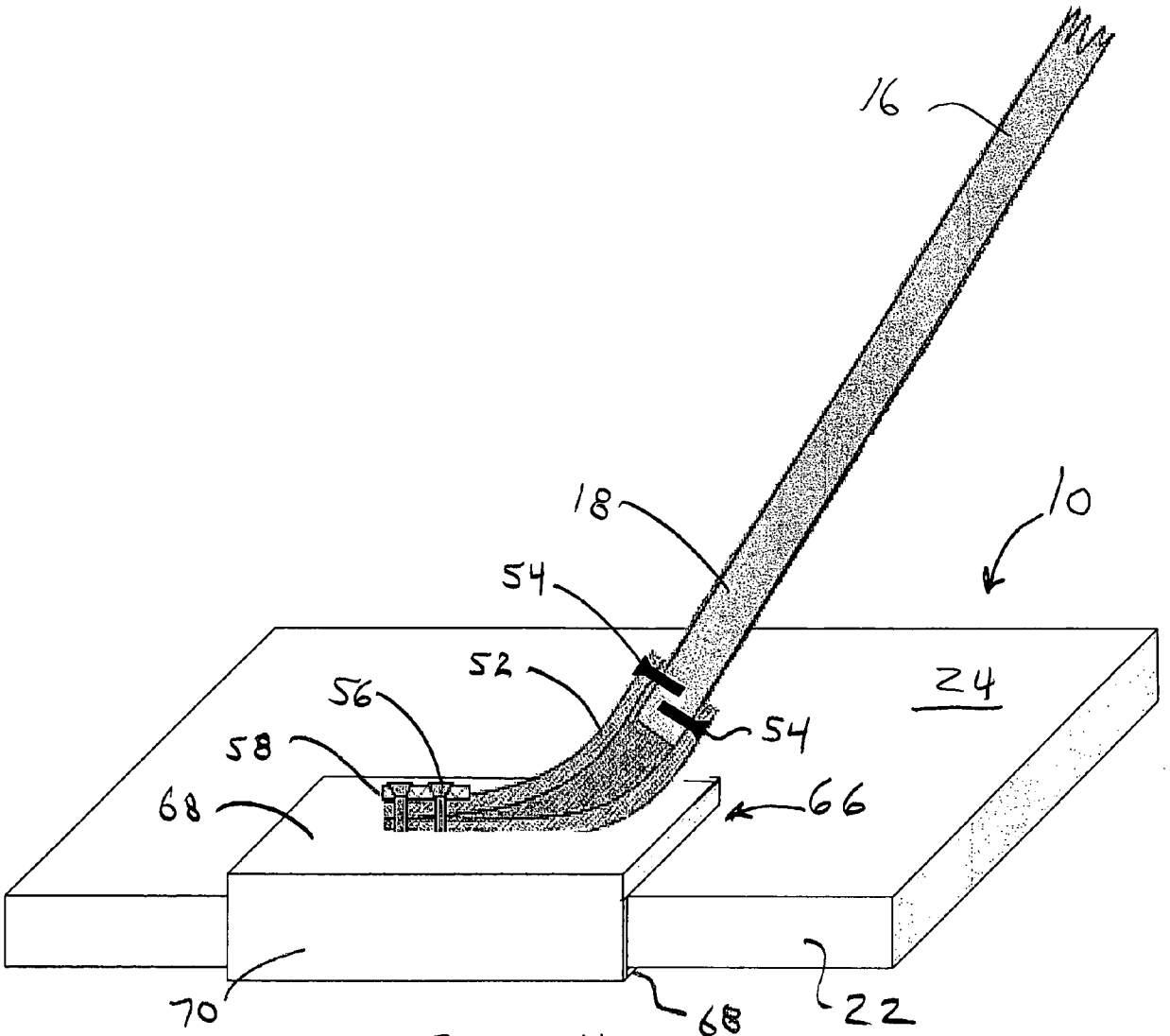
FIG. 11 is a fragmentary, sectional isometric view of the skim board, illustrating a removable clapped engagement of the flexible pole to an edge of the skim board.

Now referring to FIG. 11, there is illustrated another arrangement for releasably connecting the poles 16 to the skim board 10. The pole 16 is connected at lower end portion 18 by fasteners 54 to a section of rubber tubing 52. The opposite end of the rubber tubing is connected by fasteners 56 extending through bearing plate 58 and the rubber tubing 52 into engagement with a C-shaped clamp 66. The clamp 66 includes a pair of parallel overlying, spaced flange plates 68 connected by a web 70. The spacing between the flange plates 68 is substantially the thickness of the skim board 10, as shown in FIG. 14.

Figure 14:
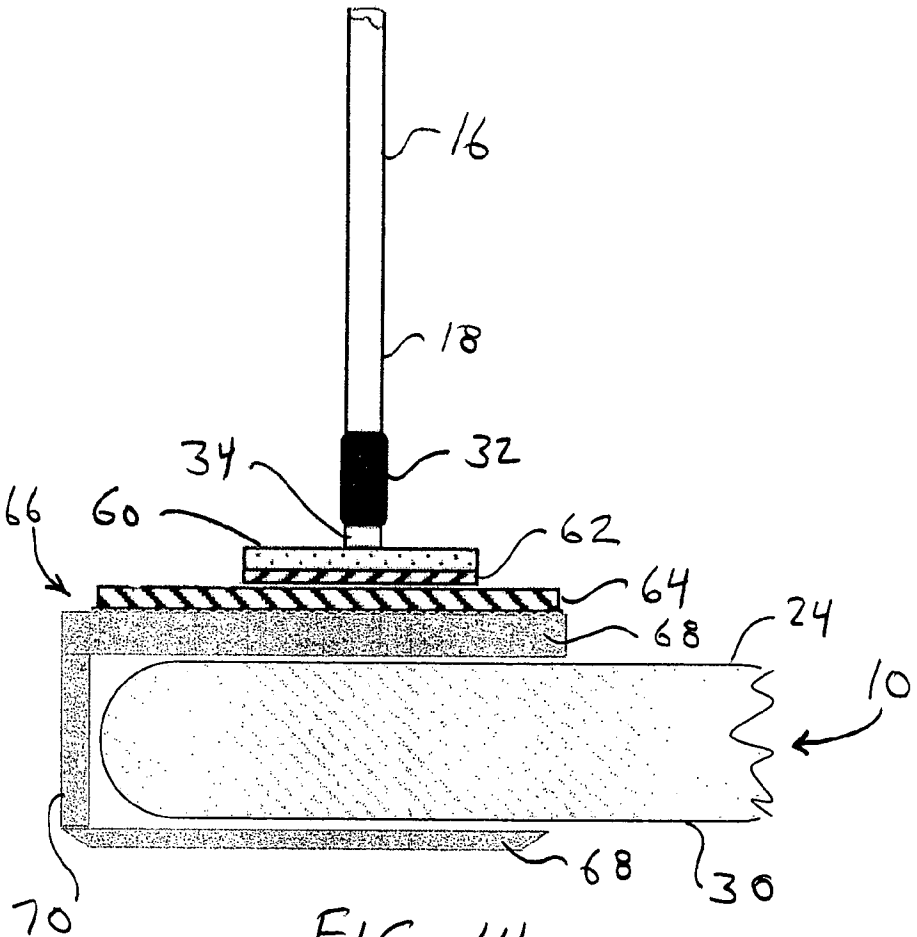
FIG. 14 is a fragmentary, sectional view in side elevation of the clamp for supporting the flexible pole on the edge of the skim board.
Figure 13:
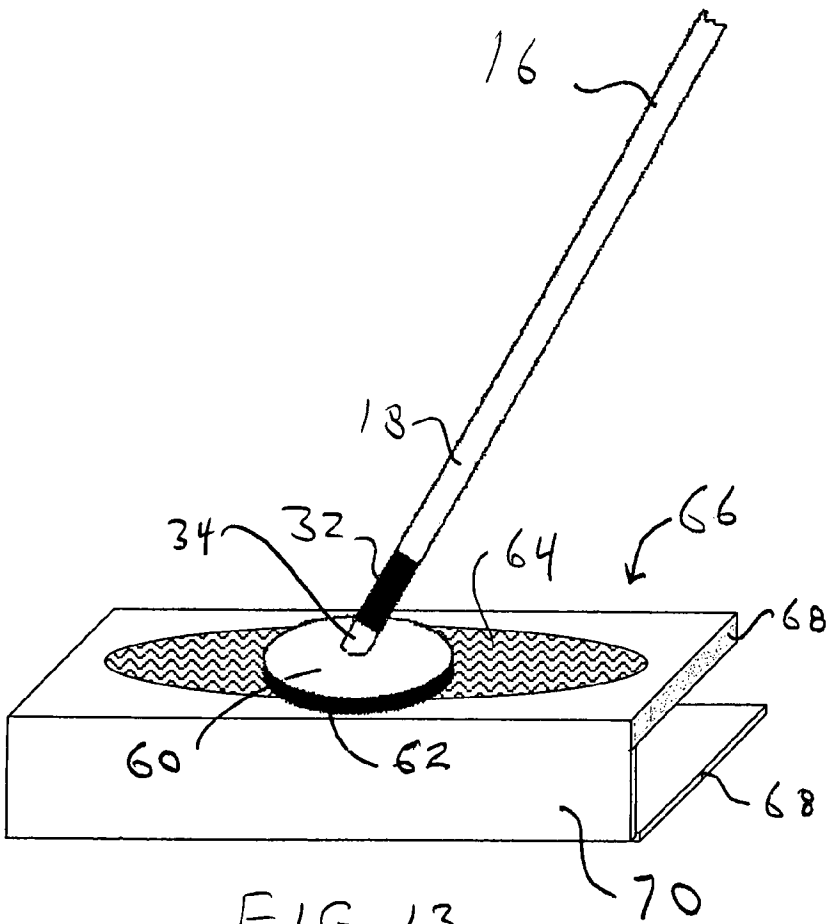
FIG. 13 is a fragmentary isometric view of the clamp for removably attaching the flexible pole to the skim board.

The skim board 10 is received between the plates 68 which are advanced into contact with board upper surface 24 and bottom surface 30 until the board lateral edge portion 22 abuts the web 70, as shown in FIG. 14. In this position, the clamp 66 is securely positioned on the board 10. When desired to change the position of the clamp 66 along the board lateral edge portion 22, the clamp 66 is removed from engagement with the board 10 and advanced to a selected position on the board lateral edge portion 22. The clamp 66 is fabricated of a selected material including metal, plastic, and rubber.

Figure 12:
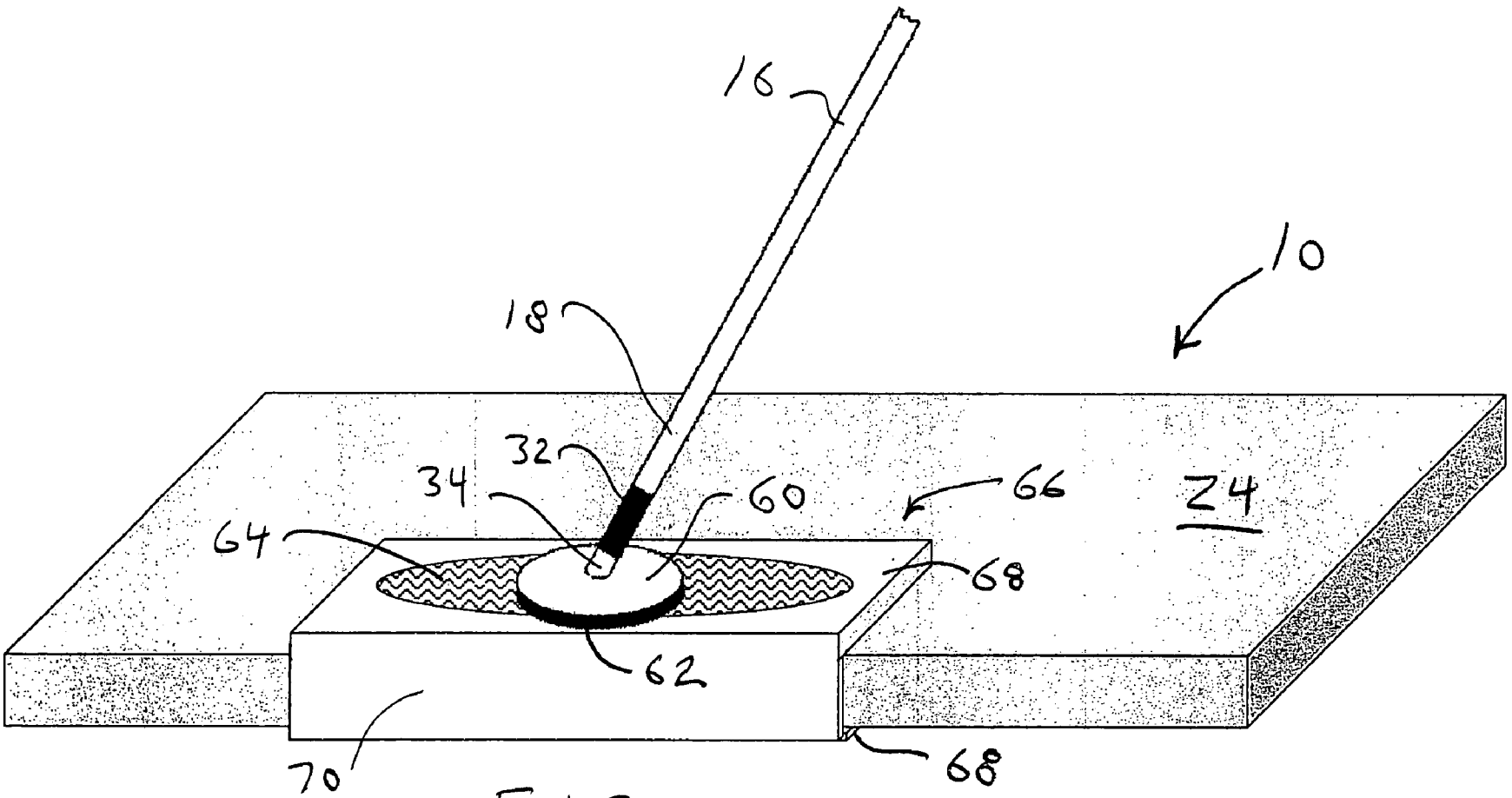
FIG. 12 is a view of the skim board similar to FIG. 11, illustrating the flexible pole removably connected to a clamp for releasably engaging the edge of the skim board.

Another embodiment of the C-clamp connection of the pole 16 to the lateral edge portions 22 of the board 10 is shown in FIG. 12. In this embodiment, the pole 16 is movably positioned on the clamp upper flange plate 68 by provision of the combination hook and loop fastener portions 62 and 64, as above described. The pole 16 is connected at its base through the flexible joint 32 to the stub shaft 34 extending upwardly from the bearing plate 60. The bottom of the bearing plate 60 includes the hook and loop fastener portion 62 that is engagable with the hook and loop fastener portion 64 on the clamp the upper flange plate 68.

With the arrangement shown in FIGS. 12 and 14, the C-clamp 66 is adjustable to a preselected position on the board lateral edge portion 22. The pole 16 is also adjustable to a selected position along the length of the clamp 66. While the C-clamp 66 securely connects the pole 16 to the board 10, the clamp 66 is also movable on the board 10. The movable fitting of the C-clamp 66 on the board 10 is illustrated in FIG. 12. Once the C-clamp 66 is moved to the desired position on the board lateral edge portion 22, it is maintained in position during maneuvering of the board.

Figures 15, 16:
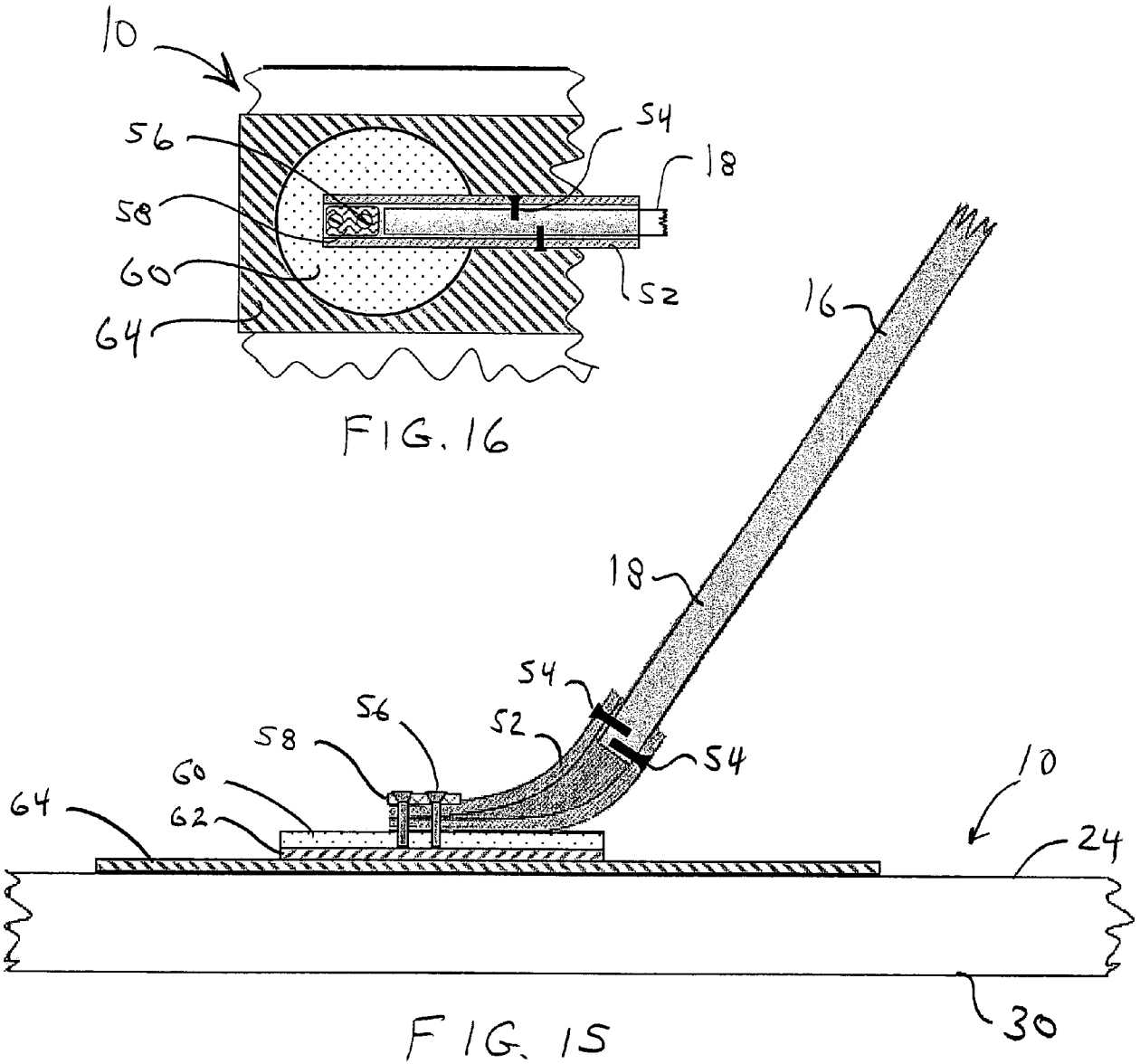
FIG. 15 is a fragmentary, sectional view in side elevation of a flexible pole mounted on the board for selective positioning on the board.
FIG. 16 is a fragmentary, sectional top plan view of the skim board shown in FIG. 15.

Referring to FIGS. 15 and 16, there is illustrated an embodiment of the flexible connection of the pole 16 to the skim board 10 where the pole 16 is removably attached to the board upper surface 24. As described above, the pole 16 is connected by fasteners 54 to the upper end of a rubber tube 52. The lower end of the rubber tube 52 is connected by fasteners 56 extending through bearing plate 58 and the rubber tubing 52 into engagement with the circular plate 60.

As above described, a hook and loop fastener portion 62 is connected to the bottom of plate 60, and a cooperating hook and loop fastener 64 is secured to the board upper surface 24. With this arrangement, the circular plate 60 is advanced to a selected position along the length of the fastener portion 64, which is preferably, located adjacent board lateral edge portion 22.

Figures 17, 18:
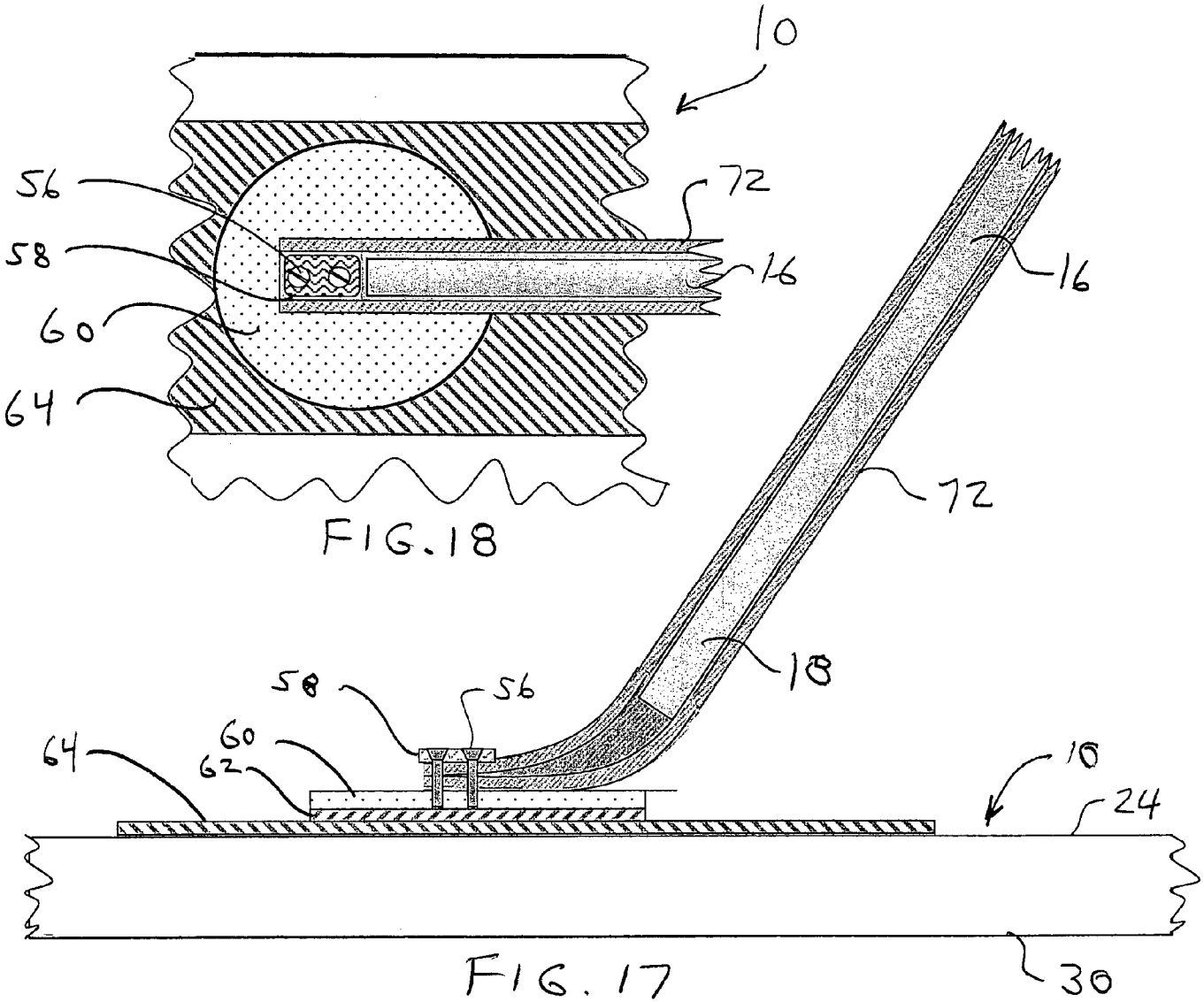
FIG. 17 is a view of the skim board similar to FIG. 15, illustrating another embodiment for removably connecting the flexible pole to the surface of the skim board.
FIG. 18 is a fragmentary, sectional top plan view of the skim board shown in FIG. 17.

FIGS. 17 and 18 illustrate a further embodiment of the pole construction that is removably secured by the hook and loop fastener portions as above described in FIGS. 15 and 16. The pole construction shown in FIGS. 17 and 18 includes the pole 16 positioned within flexible plastic tubing 72 that extends the full length of the pole 16 with a lower end portion extending beyond the end of the pole for connection by the fasteners 56 to the top of circular plate 60. The plate 60 is movably positioned on the hook and loop fastener portion 64.

The pole 16 is fabricated of a selected material and is not limited to plastic. Other material for the poles 16 includes nylon, rubber, and carbon. Preferably, the material from which the pole 16 is fabricated allows bending or slight deformation of the pole 16. The poles 16 will not break under pressure applied by the rider in maneuvering the skim board by grasping the poles 16 to accelerate the board 10 in the surf, as shown in FIG. 2*a*. In this maneuver, the poles 16 are sufficiently rigid to transfer the force for accelerating the board 10. If desired, the poles 16 are covered with a soft resilient material, such as plastic or foam rubber.

As above described, the poles 16 are connected in a manner that secures them in a fixed position on the skim board 10 or to selected positions along the length of the skim board 10. In an alternate embodiment, the skim board 10 includes predrilled holes that receive bolts or rods extending from the end of the poles. Also, as above described, the poles 16 are provided at their base with a flexible joint 32 that engages a stub shaft 34 extending upwardly from the surface of the board 10. Not only are the poles 16 releasably connected to the surface 24 of the board 10 by the provision of hook and loop fastener portions 62, 64 and a C-clamp 66, magnets, suction cups and double-sided tape are also used.

In another embodiment for removably positioning the poles 16 on the skim board 10, a bowl or well-shaped receiver (not shown) is positioned on the upper surface 24 of the board 10 adjacent the lateral edge portions 22. The end of a pole 16 is tightly received in the bowl or well-shaped receiver so that when the rider pushes the pole to accelerate the board, the poles remain in the bowl or well-shaped receiver. Then, as soon as the rider has jumped on the board and balance is established, the pole is pulled out of the bowl or the well-shaped receiver. At this point, the rider may either continue to hold the pole or toss the pole aside clear of the gliding path of the skim board 10. The rider then maneuvers the skim board 10 without the provision of poles 16.

Figure 19:
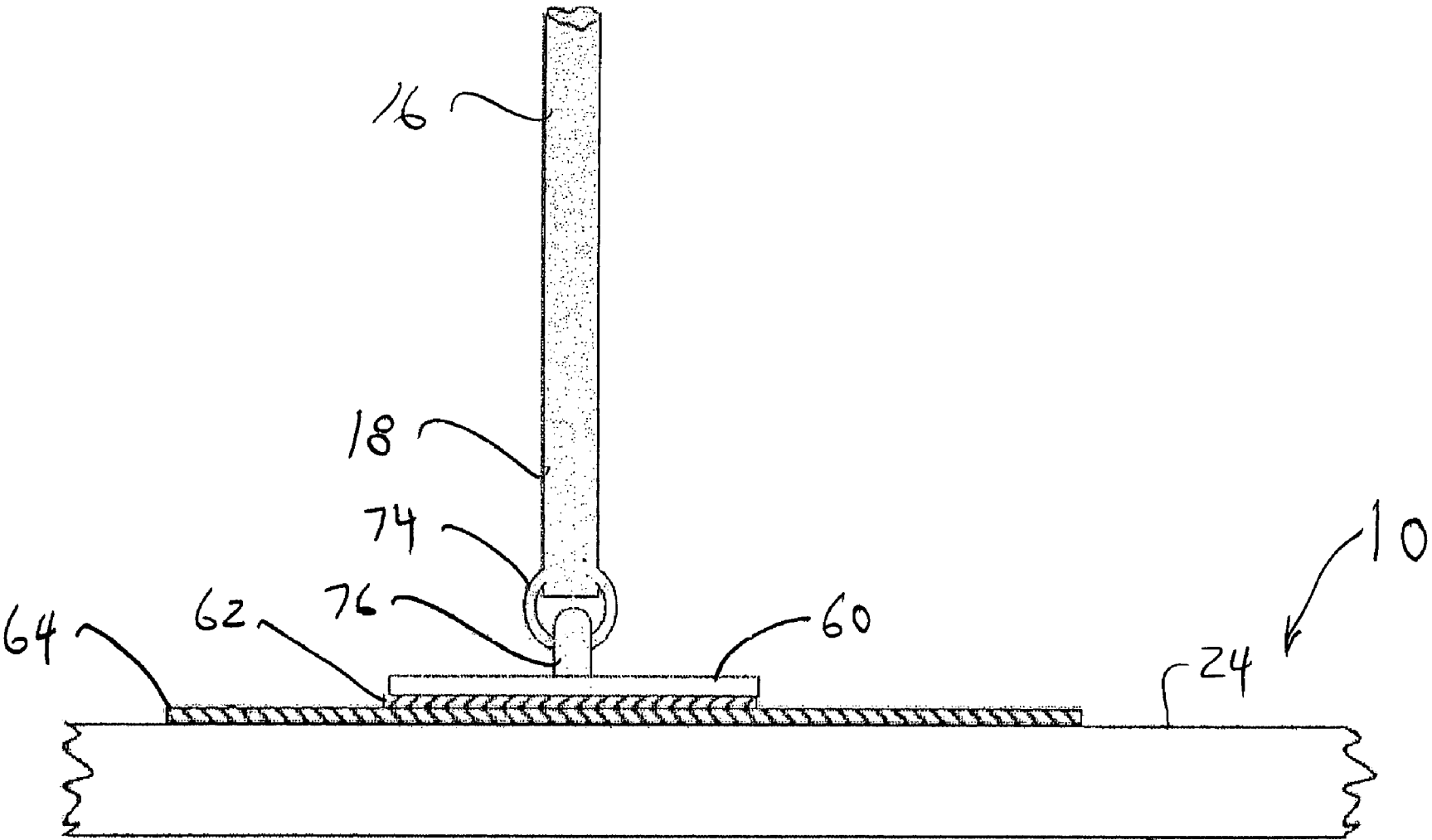
FIG. 19 is a fragmentary, sectional view in side elevation of the skim board, illustrating another embodiment for releasably connecting a pivotal pole to the surface of the skim board.

Now referring to FIG. 19, there is illustrated a further embodiment of pivotally connecting the poles 16 to the skim board 10. The pole 16 is provided at lower end portion 18 with a hole for receiving a split ring 74. The ring 74 extends through the opening of a ring 76 that is anchored to circular plate 60. As above described, the circular plate 60 is provided with a hook and loop fastener portion 62 that is releasably engagable with the hook and loop fastener portion 64 secured to the upper surface 24 of board 10.

As shown in FIG. 19, the pole 16 is pivotal on the ring 74 in the lateral and transverse axes of the board 10. The pole 16 with the ring 74 is pivotal on the ring 76 also about the lateral and transverse axes of the skim board 10. This combination of independent movements of the pole 16 relative to the surface of the board 10 facilitates a wide range of pole maneuvering. The rider is able to achieve the desired angular position of the poles to maintain balance and control of the direction of movement of the board as it glides on the shallow waves on a beach.

The length of the poles 16 of the skim board 10 varies depending upon the height of the rider and the dimensions of the skim board. The handles must be sufficiently long to ensure that the rider has room to run behind the board and maintain control of the board. However, the poles 16 cannot be so long that the rider finds himself too far behind the board, making it difficult to jump on the board. Once the desired acceleration of the board has been achieved, the rider jumps on the board. Smaller riders will find that shorter poles are needed for smaller boards.

Figure 21:
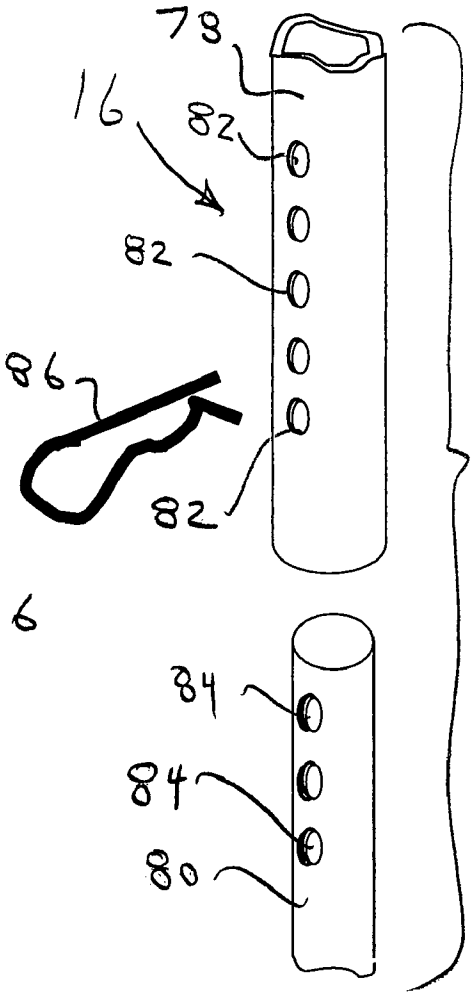
FIG. 21 is a fragmentary exploded view of the grip portion of the pole shown in FIG. 20, illustrating the pole sections for adjusting the length of the pole.
Figure 20:
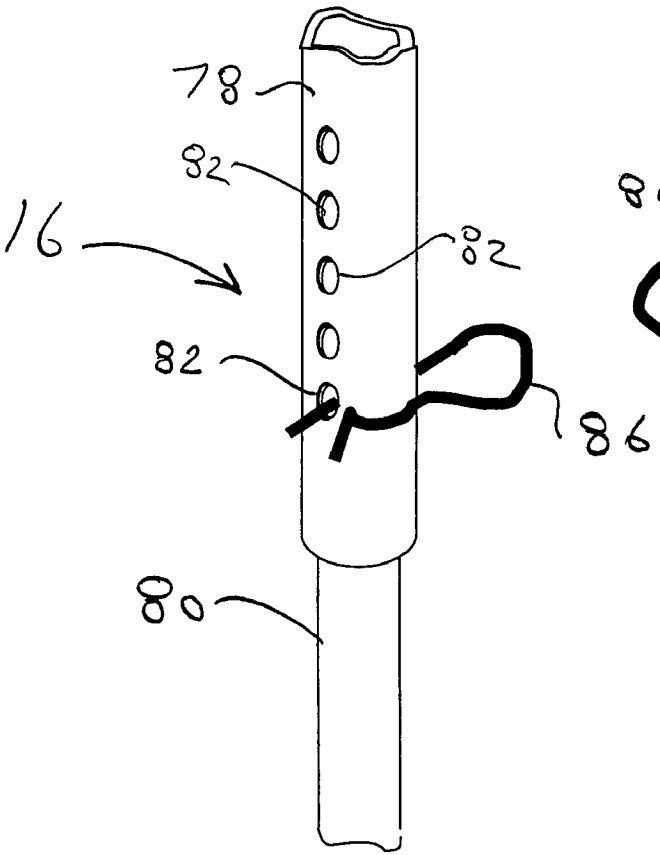
FIG. 20 is an isometric fragmentary view of the grip portion of a pole, illustrating interconnecting pole sections for telescopically adjusting the length of the pole.

In the embodiment of the present invention illustrated in FIGS. 20 and 21, the poles 16 are telescopically extensible to adjust the length of the poles. The pole 16 telescopes by the provision of a hollow pole segment 78 at the upper end slidable on a hollow pole segment 80 at the lower end. The overlapping portions of the pole segments 78 and 80 are provided with holes 82 and 84 vertically spaced on the segments 78 and 80. The segments 78 and 80 slide into engagement. At the desired length of the pole, the segments 78 and 80 are secured to one another by a conventional locking clip 86 extending through the aligned holes 82 and 84.

Further, in accordance with the present invention, the length of the poles 16 is adjustable by the addition or subtraction of individual shaft segments that extend between the upper end of the pole and the lower end of the pole. By providing for adjustments in the length of the poles, the rider is assured of achieving the desired length of the poles for pushing the poles as the rider runs behind the board.

Figure 22:
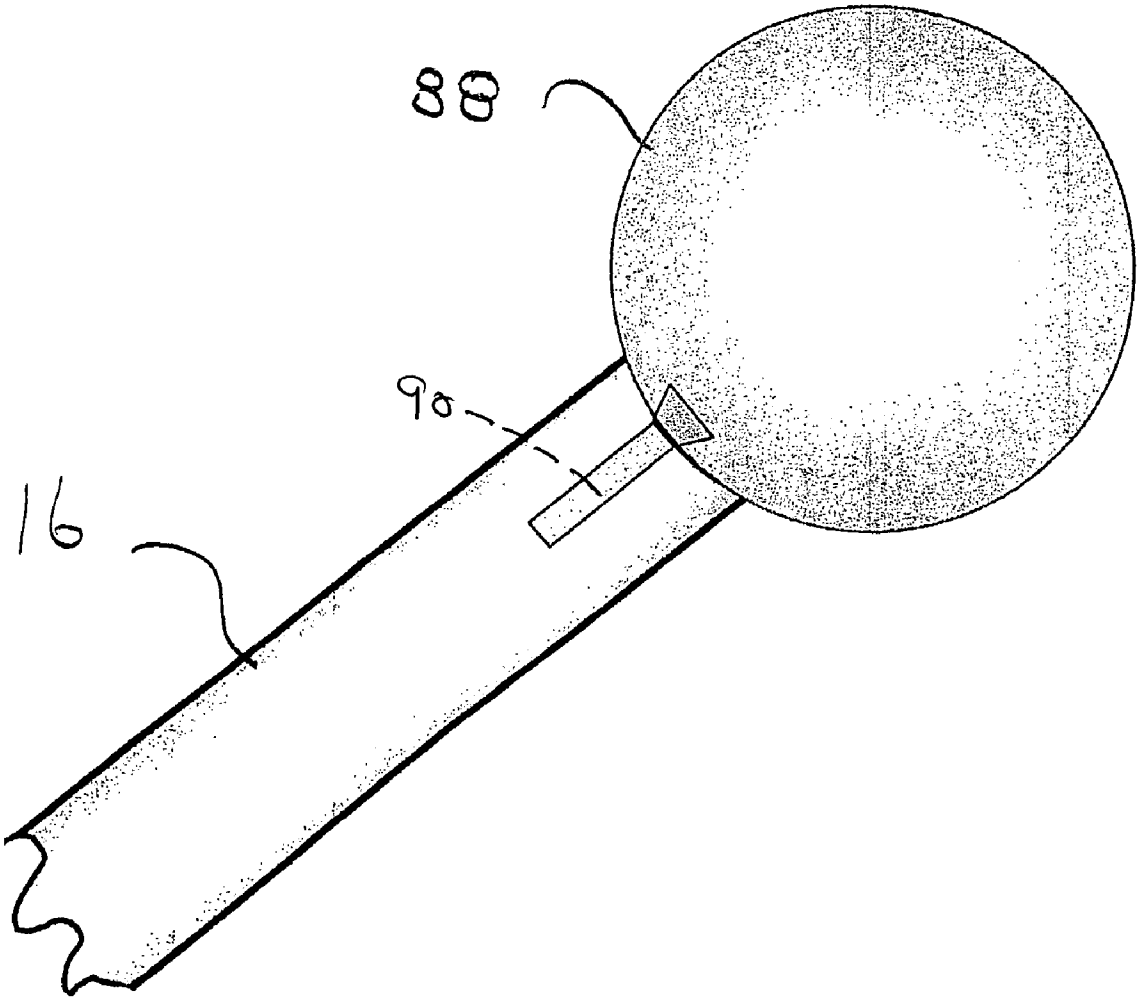
FIG. 22 is a fragmentary view in side elevation of the grip portion of a pole, illustrating a spherical handle.
Figure 23:
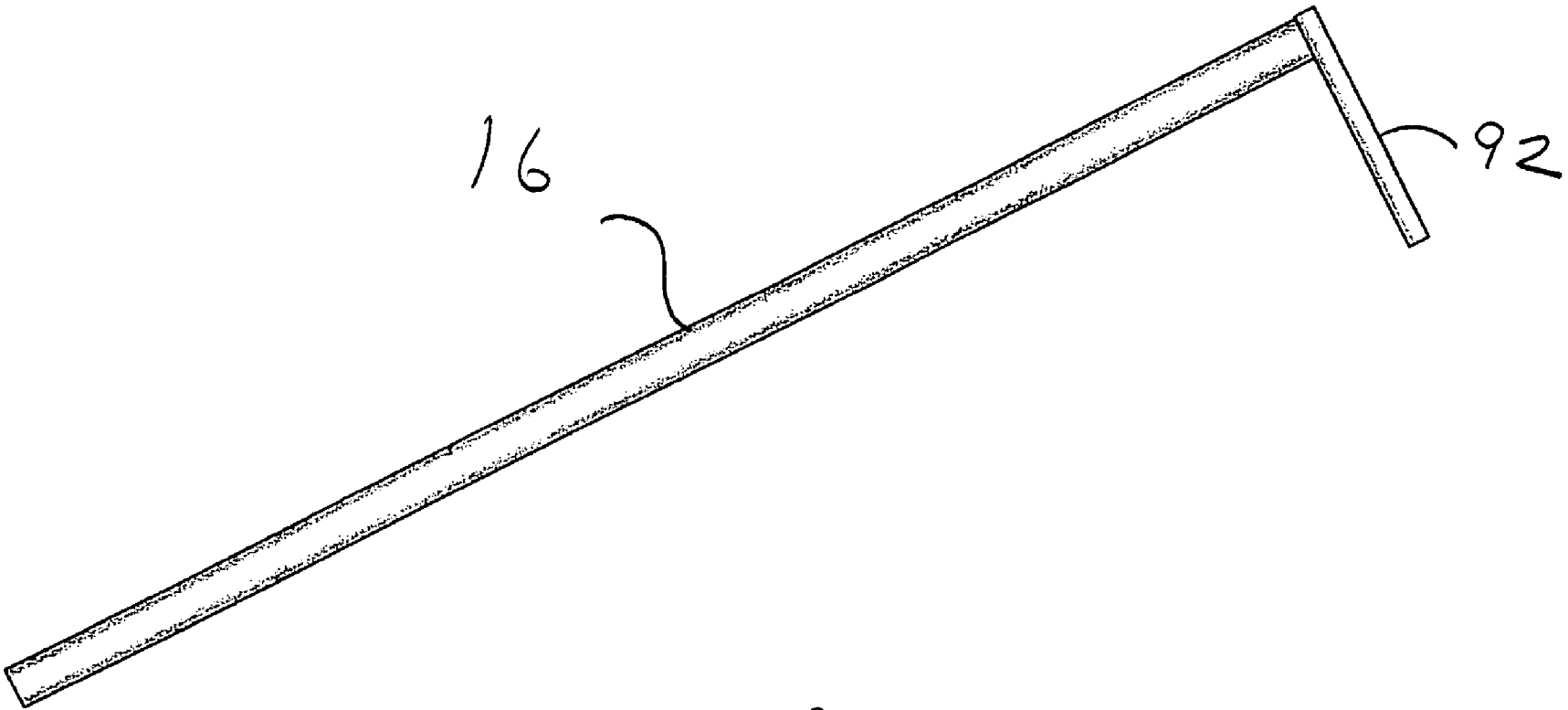
FIG. 23 is a view of the pole similar to FIG. 22, illustrating another embodiment of a handle on the end of the pole.
Figure 24:
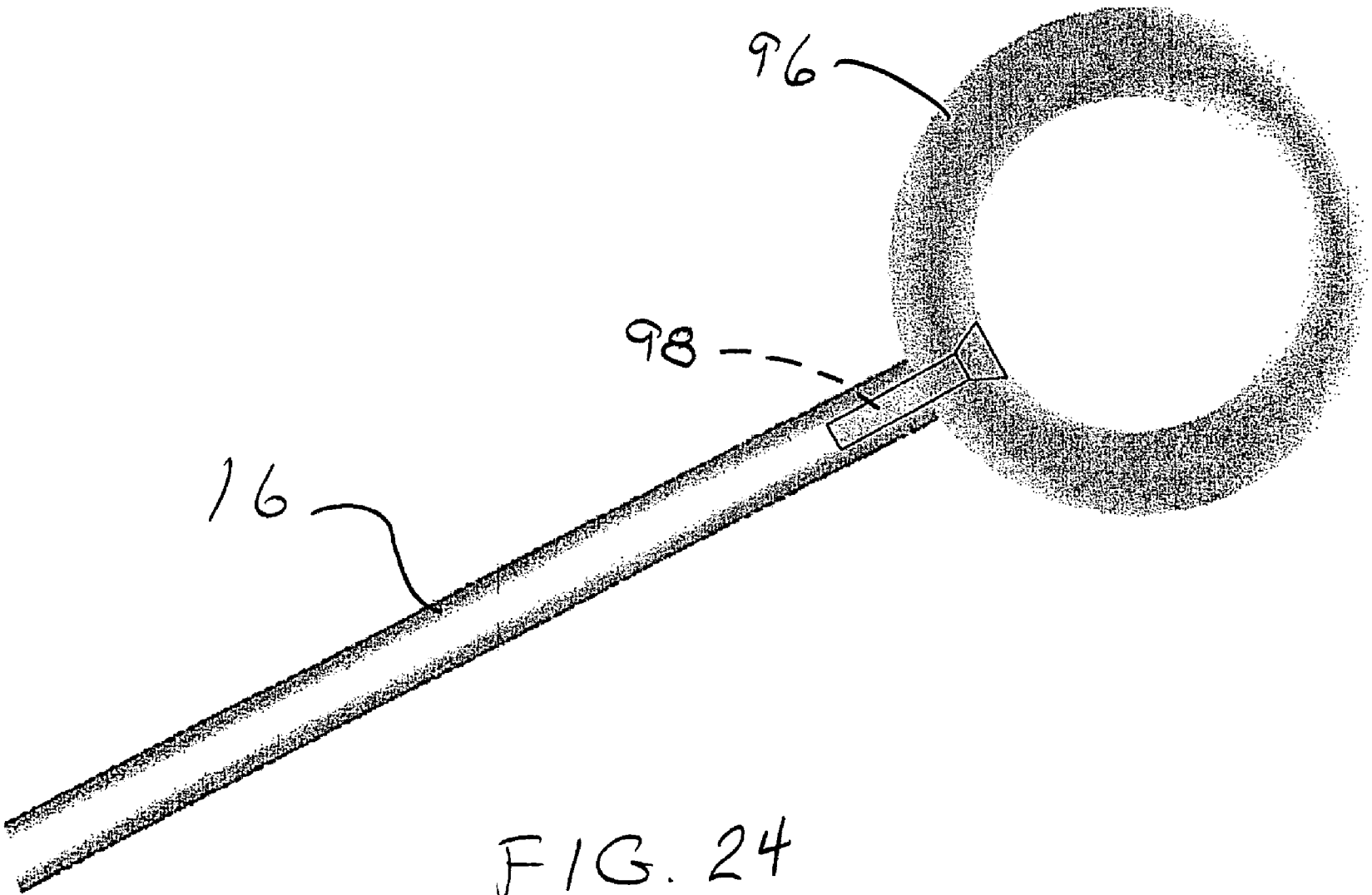

To facilitate secure gripping of the poles in the maneuvering of the skim board by the rider, a number of different grip configurations are available. For example, as shown in FIG. 22, the pole 16 at the upper end portion includes a spherical or ball-shaped grip 88, which is connected by screw 90 to the end of pole 16. FIG. 23 illustrates a pole grip embodiment having a handle 92 secured at right angles to the end of pole 16. Further, with the embodiment of the pole grip shown in FIG. 24, a ring-shaped handle 96 is connected by screw 98 to the end of pole 16.

It should be understood that the selected embodiment of a handle or grip attached to the end of the pole 16 may be fabricated of a selected material, such as rubber, plastic, wood and the like. The pole 16 may also be covered with any material that improves the ability of the rider to grip the pole or handle.

According to the provisions of the patent statutes, I have explained the principle, preferred construction, and mode of operation of my invention and have illustrated and described what I now consider to represent its best embodiments. However, it should be understand that, within the scope of the appended claims, the invention may be practiced otherwise than as specifically illustrated and described.

I claim:

1. Apparatus for sliding on a low friction surface comprising:

a board having a top surface for supporting a rider standing on the board, a bottom surface for sliding on the low friction surface, a front end and a rearward end, spaced apart side edges extending the length of said board between said front end and said rearward end, a longitudinal axis of said board extending from said front end to said rearward end, a transverse axis of said board extending between said side edges, a pair of poles mounted in spaced relation on said top surface adjacent to said board side edges to provide unobstructed access for the rider to maneuver on said top surface of said board along said longitudinal and transverse axes, and said poles each having at an upper end portion a handle for gripping by the rider and at a lower end portion connecting means for attaching said poles to said board top surface to permit the rider to independently pivot said poles in a preselected direction along said longitudinal axis and said transverse axis relative to said board top surface.

2. Apparatus for sliding on a low friction surface as set forth in claim 1 including, said poles being pivotal through an angle of 180° on said longitudinal axis and through an angle of 180° on said transverse axis.

3. Apparatus for sliding on a low friction surface as set forth in claim 1 which includes, said poles being connected to said board top surface for rotation about the longitudinal axis of said poles through an angle of 360°.

4. Apparatus for sliding on a low friction surface as set forth in claim 1 which includes, said poles being removably connected to said board top surface.

5. Apparatus for sliding on a low friction surface as set forth in claim 1 which includes, said poles being fabricated of a selected material permitting the poles to flex along the length thereof.

6. Apparatus for sliding on a low friction surface as set forth in claim 1 in which, said connecting names includes a flexible joint connecting said lower end portion of each of said poles to said board upper surface to permit said poles to move from substantially a vertical position to a substantially horizontal position relative to said board top surface.

7. Apparatus for sliding on a low friction surface as set forth in claim 1 including, said poles being telescopically extensible on said board to permit adjustments in the length of said poles extending from said board top surface.

8. Apparatus for sliding on a low friction surface as set forth in claim 1 including, said poles being diametrically positioned opposite one another on said board top surface.

9. A skim board for gliding along the shallow waves on a beach comprising, a top surface for supporting a rider, a bottom surface for contacting the shallow waves flowing over the beach, said top surface defined by front and back ends and lateral edge portions, a longitudinal axis of said board extending from said front end to said back end, a transverse axis of said board extending between said lateral edge portions, a pair of poles extending upwardly from said top surface adjacent to said lateral edge portions to provide unobstructed access for the rider to maneuver on said top surface of said board along said longitudinal and transverse axes, and said poles each having a handle portion for gripping by the rider and a base portion connected to said top surface for pivotal movement along said longitudinal axis and said transverse axis controlled by the rider in getting on and off the board as the board glides on the waves.

10. A skim board for gliding along the shallow waves on a beach as set forth in claim 9 including, said poles being fabricated of material permitting said poles to flex along the length thereof.

11. A skim board for gliding along the shallow waves on a beach as set forth in claim 9 including, said poles being telescopically extensible to adjust the length of said poles from said base portion to said handle portion.

12. A skim board for gliding along the shallow waves along the beach as set forth in claim 9 including, A flexible joint connected at one end to said base portion of each of said poles and at an opposite end to said board top surface to allow pivotal movement of said poles from substantially a vertical position to a horizontal position relative to said board top surface.

13. A skim board for gliding along the shallow waves on a beach as set forth in claim 9 including, said base portion of said poles being releasably connected to said board top surface.

14. A skim board for gliding along the shallow waves on a beach as set forth in claim 9 including, said poles being flexible along the length thereof and attached at said base portion to allow the rider to pivot said poles to a preselected angular position relative to said board top surface.

15. A method for controlling the movement of a skim board gliding on the surface of shallow water on a beach comprising the steps of:

pivotally connecting a pair of poles to lateral sides of the skim board for movements of the poles by a rider ranging between a vertical position and a horizontal position relative to the surface of the skim board, accelerating movement of the skim board on the water surface by the rider running behind the skim board on the beach while gripping the ends of the poles to forwardly propel the skim board on the water surface, pivoting the poles to a preselected position on the skim board by the rider as the skim board glides on the water surface, reaching a preselected speed of the skim board on the water for the rider to step on to the surface of the skim board, while continuing to maintain control of the skim board on the water surface by the rider pivoting the poles, maintaining balance of the rider on the skim board by selectively pivoting the poles as the skim board glides on the water surface, and terminating forward movement of the skim board on the water surface by the rider stepping off of the surface of the skim board onto the beach, while continuing to grip the poles and maintain control of the skim board when off of the skim board.

16. A method as set forth in claim 15 which includes, removably connecting the pair of poles to the skim board.

17. A method as set forth in claim 15 which includes, connecting the poles to the skim board at preselected positions at lateral edges of the skim board to selectively pivot the poles through an angle of 180° along a longitudinal axis of the skim board and through an angle of 180° along a transverse axis of the skim board.

18. A method as set forth in claim 15 which includes, connecting the poles to the skim board to rotate through an angle of 360° around the longitudinal axis of the poles.

19. A method as set forth in claim 15 which includes, adjusting the position of the poles to a preselected position on the lateral sides of the skim board for pivotal movement.

* * * * *